US011640902B2

(12) United States Patent
Kobayashi et al.

(10) Patent No.: US 11,640,902 B2
(45) Date of Patent: May 2, 2023

(54) ION DETECTOR AND MASS SPECTROMETER EACH INCLUDING MULTIPLE DYNODES

(71) Applicant: HAMAMATSU PHOTONICS K.K., Hamamatsu (JP)

(72) Inventors: Hiroshi Kobayashi, Hamamatsu (JP); Junichi Kondo, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 104 days.

(21) Appl. No.: 17/241,224

(22) Filed: Apr. 27, 2021

(65) Prior Publication Data

US 2021/0343517 A1 Nov. 4, 2021

(30) Foreign Application Priority Data

May 1, 2020 (JP) ..... JP2020-081386
Mar. 24, 2021 (JP) ..... JP2021-050697

(51) Int. Cl.
*H01J 49/02* (2006.01)
*H01J 43/10* (2006.01)
*H01J 43/22* (2006.01)

(52) U.S. Cl.
CPC ..... *H01J 49/025* (2013.01); *H01J 43/10* (2013.01); *H01J 43/22* (2013.01)

(58) Field of Classification Search
CPC ..... H01J 49/025; H01J 43/10; H01J 43/22
See application file for complete search history.

(56) References Cited

U.S. PATENT DOCUMENTS 4,810,882 A 3/1989 Bateman
8,975,592 B2 3/2015 Kobayashi et al.

FOREIGN PATENT DOCUMENTS

JP S63-276862 A 11/1988
JP H04-233151 A 8/1992
JP 2012-049110 A 3/2012

*Primary Examiner* — Joseph L Williams
(74) *Attorney, Agent, or Firm* — Faegre Drinker Biddle & Reath LLP

(57) ABSTRACT

An ion detector includes a first dynode, a second dynode, a scintillator, a conductive layer, and a photomultiplier tube. The first dynode is configured to emit a charged particle in response to the incidence of the ion. The second dynode is configured to be given a negative potential and emit a secondary electron in response to incidence of the charged particle from the first dynode. The scintillator includes an electron incident surface arranged to receive the secondary electron from the second dynode, and is configured to convert the secondary electron into light. The conductive layer is disposed on the electron incident surface. The photomultiplier tube is configured to detect the light from the scintillator.

21 Claims, 15 Drawing Sheets

ION DETECTOR AND MASS SPECTROMETER EACH INCLUDING MULTIPLE DYNODES

BACKGROUND OF THE INVENTION

1. Field of the Invention

At least one aspect of the present invention relates to an ion detector. Another aspect of the present invention relates to a mass spectrometer.

2. Description of Related Art

Known ion detectors detect positive or negative ions (see, for example, Japanese Unexamined Patent Publication No. S63-276862 and Japanese Unexamined Patent Publication No. H4-233151). The ion detector disclosed in Japanese Unexamined Patent Publication No. S63-276862 includes a dynode that emits a secondary electron due to collision of the positive ion, a dynode that emits the secondary electron due to collision of the negative ion, a scintillator on which the secondary electron is incident, and a photomultiplier tube that detects light generated by the scintillator. The ion detector disclosed in Japanese Unexamined Patent Publication No. H4-233151 includes a first conversion dynode that generates a positive ion in response to incidence of the negative ion, a second conversion dynode that converts the positive ion from the first conversion dynode into an electron, and a secondary electron multiplier tube that detects the electron from the second conversion dynode.

SUMMARY OF THE INVENTION

In order to extend a life-span of the ion detector, it is desirable to realize an ion detector including at least two configurations. That is, it is desirable to realize an ion detector including a configuration in which the ion detector includes a scintillator and a photomultiplier tube that detects light emitted from the scintillator, and a configuration in which an electric potential given to the scintillator is possibly set low. Therefore, it is desirable for the ion detector to realize an ion detector including a configuration in which, regardless of whether an ion to be detected is a positive ion or a negative ion, the ion to be detected is converted into an electron and light converted from the electron by the scintillator is detected by the photomultiplier tube.

In order to extend the life-span of the ion detector, it is also desirable to realize an ion detector including another configuration. That is, it is desired that the ion detector is provided with a diode that possibly withstands long-term use. Therefore, it is desirable for the ion detector to realize an ion detector including a configuration in which, regardless of whether the ion to be detected is a positive ion or a negative ion, the ion to be detected is converted into an electron and the converted electron is detected by the diode.

Japanese Unexamined Patent Publication No. S63-276862 discloses the scintillator and the photomultiplier tube, but does not disclose a configuration in which a positive ion converted from a negative ion to be detected is converted into an electron. Japanese Unexamined Patent Publication No. H4-233151 does not disclose the scintillator and the photomultiplier tube. Neither Japanese Unexamined Patent Publication No. S63-276862 nor Japanese Unexamined Patent Publication No. H4-233151 discloses a diode as an ion detector.

An object of the first to third aspects of the present invention is to provide an ion detector having a long life-span. An object of the fourth aspect of the present invention is to provide a mass spectrometer including an ion detector having a long life-span.

An ion detector according to the first aspect is an ion detector that detects an incident ion, and includes a first dynode configured to emit a charged particle in response to the incidence of the ion, a second dynode configured to be given a negative potential and emit a secondary electron in response to incidence of the charged particle from the first dynode, a scintillator including an electron incident surface arranged to receive the secondary electron from the second dynode, and configured to convert the secondary electron into light, a conductive layer disposed on an electron incident surface, and a photomultiplier tube configured to detect the light from the scintillator.

According to the first aspect, the ion detector includes the scintillator and the photomultiplier tube configured to detect the light emitted from the scintillator. The ion detector includes the first and second dynodes. The first dynode emits the charged particle in response to the incidence of an ion. The second dynode emits the secondary electron in response to the incidence of the charged particle from the first dynode. The secondary electron from the second dynode is incident on the scintillator. The scintillator converts the incident secondary electron into light even when the given electric potential is low. Since the potential given to the scintillator is possibly set low, the life-span of the ion detector is extended.

In the first aspect, the scintillator may include a light exit surface arranged to emit light. The photomultiplier tube may include a light incident window arranged to receive the light from the light exit surface. The light exit surface may be disposed in close proximity to the light incident window.

In this case, optical loss of light incident on the photomultiplier tube from the scintillator is reduced. Even in a case the electric potential given to the photomultiplier tube is low, photodetection sensitivity in the photomultiplier tube is ensured.

In the first aspect, the first dynode may be configured to be given a negative potential to convert a positive ion into the secondary electron, and the second dynode may be configured to allow the secondary electron from the first dynode to be incident on the electron incident surface of the scintillator, in the ion detector configured to detect the positive ion.

In this case, the positive ion incident on the ion detector is converted into the secondary electron by the first and second dynodes. The converted secondary electron is incident on the scintillator. The scintillator reliably converts the incident secondary electron into light even in a case the given potential is low.

In the first aspect, the first dynode may be configured to be given a positive potential to convert a negative ion into a positive ion, and the second dynode may be configured to convert the positive ion from the first dynode into the secondary electron and allow the secondary electron to be incident on the electron incident surface of the scintillator, in the ion detector configured to detect the negative ion.

In this case, the negative ion incident on the ion detector is converted into the secondary electron by the first and second dynodes. The secondary electron from the second dynode is incident on the scintillator. The scintillator reliably converts the incident secondary electron into light even in a case the given potential is low.

In the first aspect, the scintillator may be configured to be given a negative potential. The second dynode may be configured to be given the negative potential whose magnitude is larger than a magnitude of the negative potential given to the scintillator.

In this case, the scintillator is given an electric potential lower than the magnitude of the negative potential given to the second dynode.

In the first aspect, the second dynode may be configured to be given a negative potential whose magnitude is between a magnitude of the negative potential given to the first dynode and a magnitude of the negative potential given to the scintillator, in the ion detector configured to detect a positive ion.

In this case, the second dynode is given an electric potential lower than the magnitude of the negative potential given to the first dynode.

In the first aspect, the photomultiplier tube may include a side tube configured to be given a cathode potential. The conductive layer may be electrically connected to the side tube.

In this case, the electric potential of the scintillator is approximately the same as the cathode potential of the photomultiplier tube. A single power source may supply electric power to the scintillator and the photomultiplier tube. The number of power supplies is reduced.

The first aspect may include a cover covering the second dynode. The cover may include a first passage port arranged to allow the charged particle from the first dynode to pass therethrough and a second passage port arranged to allow the secondary electron from the second dynode to pass therethrough.

In this case, the secondary electron emitted from the second dynode is more reliably directed to the scintillator.

The first aspect may include a mesh covering the first passage port and being configured to be given a negative potential.

In this case, the mesh reduces that the secondary electron passes through the first passage port and is directed from the second dynode to the first dynode. The secondary electron emitted from the second dynode is more reliably directed to the scintillator.

In the first aspect, the first dynode may be disposed to be spaced apart from a virtual plane including the second dynode, the second passage port, and the electron incident surface of the scintillator. The first dynode may be configured to allow the charged particle from the first dynode to be incident on the second dynode from a direction intersecting the virtual plane.

In this case, the secondary electron emitted from the second dynode tends not to be directed to the first dynode. The secondary electron emitted from the second dynode more reliably tends to be directed to the scintillator.

An ion detector according to the second aspect is an ion detector that detects an incident ion, and includes a first dynode configured to emit a charged particle in response to the incidence of the ion, a second dynode configured to be given a negative potential and emit a secondary electron in response to incidence of the charged particle from the first dynode, and a diode including an electron incident surface arranged to receive the secondary electron from the second dynode, and configured to detect the incident secondary electron.

According to the second aspect, the ion detector includes the diode. The first dynode emits the charged particle in response to the incidence of the ion. The second dynode emits the secondary electron in response to the incidence of the charged particle from the first dynode. The secondary electron from the second dynode is incident on the diode. Since the diode possibly withstands long-term use, the life-span of the ion detector is extended.

In the second aspect, the first dynode may be configured to be given a negative potential to convert a positive ion into the secondary electron, and the second dynode may be configured to allow the secondary electron from the first dynode to be incident on the electron incident surface, in the ion detector configured to detect the positive ion.

In this case, the positive ion incident on the ion detector is converted into the secondary electron by the first and second dynodes. The converted secondary electron is incident on the diode. The diode reliably detects the incident secondary electron and outputs an electric signal.

In the second aspect, the first dynode may be configured to be given a positive potential to convert a negative ion into a positive ion, and the second dynode may be configured to convert the positive ion from the first dynode into the secondary electron and allow the secondary electron to be incident on the electron incident surface, in the ion detector configured to detect the negative ion.

In this case, the negative ion incident on the ion detector is converted into the secondary electron by the first and second dynodes. The secondary electron from the second dynode is incident on the diode. The diode reliably detects the incident secondary electron and outputs an electric signal.

The second aspect may include a cover covering the second dynode. The cover may include a first passage port arranged to allow the charged particle from the first dynode to pass therethrough and a second passage port arranged to allow the secondary electron from the second dynode to pass therethrough.

In this case, the secondary electron emitted from the second dynode is more reliably directed to the diode.

The second aspect may further include a mesh covering the first passage port and being configured to be given a negative potential.

In this case, the mesh reduces that the secondary electron passes through the first passage port and is directed from the second dynode to the first dynode. The secondary electron emitted from the second dynode is more reliably directed to the diode.

In the second aspect, the first dynode may be disposed to be spaced apart from a virtual plane including the second dynode, the second passage port, and the electron incident surface. The first dynode may be configured to allow the charged particle from the first dynode to be incident on the second dynode from a direction intersecting the virtual plane.

In this case, the secondary electron emitted from the second dynode tends not to be directed to the first dynode. The secondary electron emitted from the second dynode is more reliably directed to the diode.

The second aspect may include a substrate on which the diode is disposed and a drive circuit configured to drive the diode. The drive circuit may include an electrical resistance element including one end electrically connected to an anode of the diode, and another end configured to be grounded. The electrical resistance element may be spaced apart from the diode and the substrate.

In this case, since the electrical resistance element is disposed to be spaced apart from the diode and the substrate, heat generated in the electrical resistance element tends not to be transferred to the diode. A gain of the diode tends not to decrease.

An ion detector according to the third aspect is an ion detector that detects an incident ion, and includes a first dynode configured to emit a charged particle in response to the incidence of the ion, a second dynode configured to be given a negative potential and emit a secondary electron in response to incidence of the charged particle from the first dynode, and a detection unit including an electron incident surface arranged to receive the secondary electron from the second dynode, and configured to detect the incident secondary electron.

According to the third aspect, the ion detector includes the detection unit that detects the incident secondary electron. The first dynode emits the charged particle in response to the incidence of the ion, and the second dynode emits the secondary electron in response to the incidence of the charged particle from the first dynode. The secondary electron from the second dynode is incident on the detection unit. Since the detection unit possibly include a configuration that withstands long-term use, the life-span of the ion detector is extended.

The mass spectrometer according to the fourth aspect includes an ionization unit configured to ionize a sample, a mass spectrometer unit configured to allow only an ion to be detected to pass among ions from the ionization unit, and the above-mentioned ion detector configured to detect the ion to be detected from the mass spectrometer unit.

According to the fourth aspect, the mass spectrometer includes an ion detector having a long life-span. The life-span of the mass spectrometer is extended.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

DETAILED DESCRIPTION OF EMBODIMENTS

Figure 1:
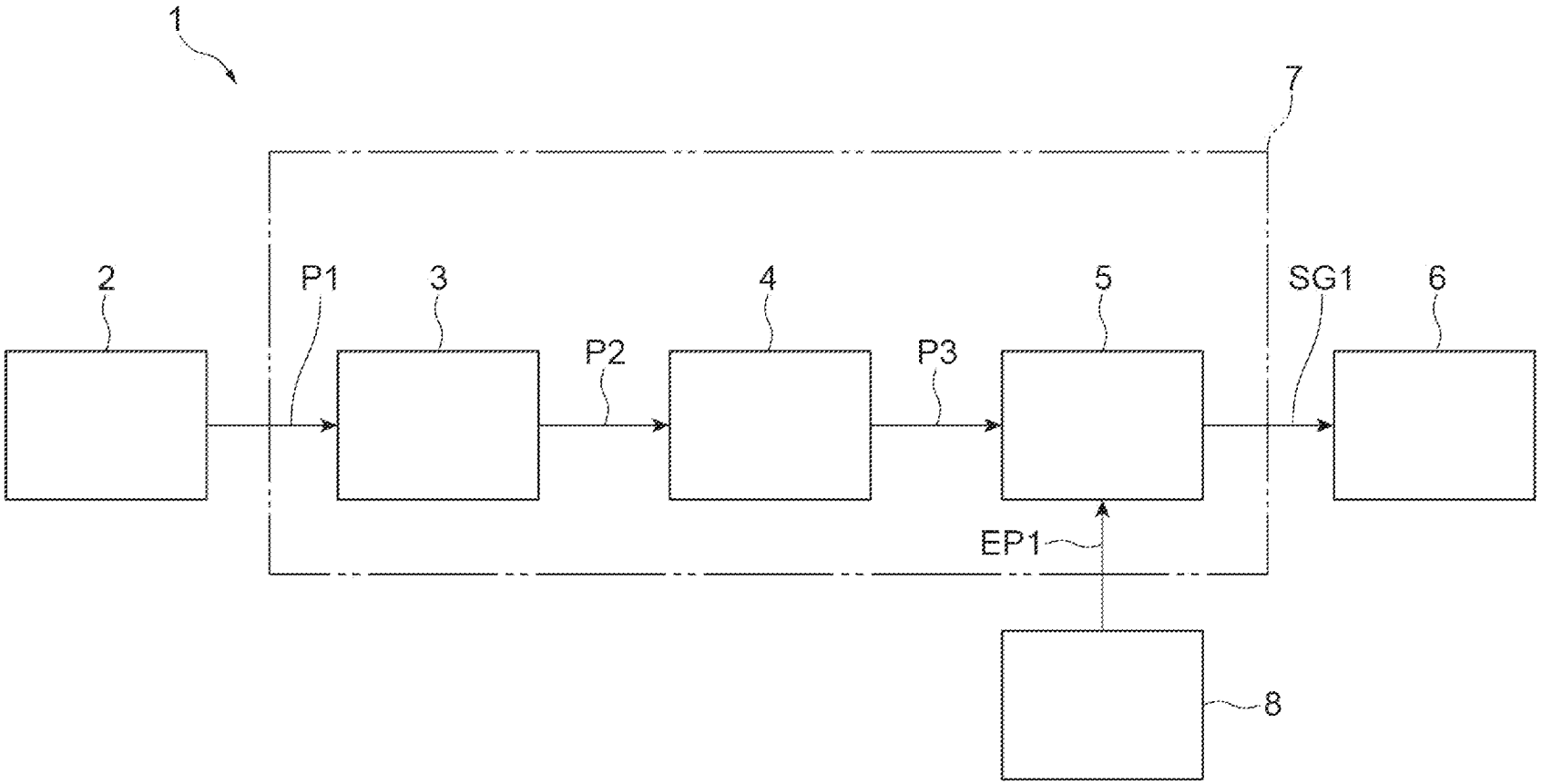
FIG. 1 is a schematic view illustrating a configuration of a mass spectrometer according to an embodiment.

Hereinafter, embodiments of the present invention will be described in detail with reference to the accompanying drawings. In the following description, the same elements or elements having the same functions are denoted with the same reference numerals and overlapped explanation is omitted.

Figure 2:
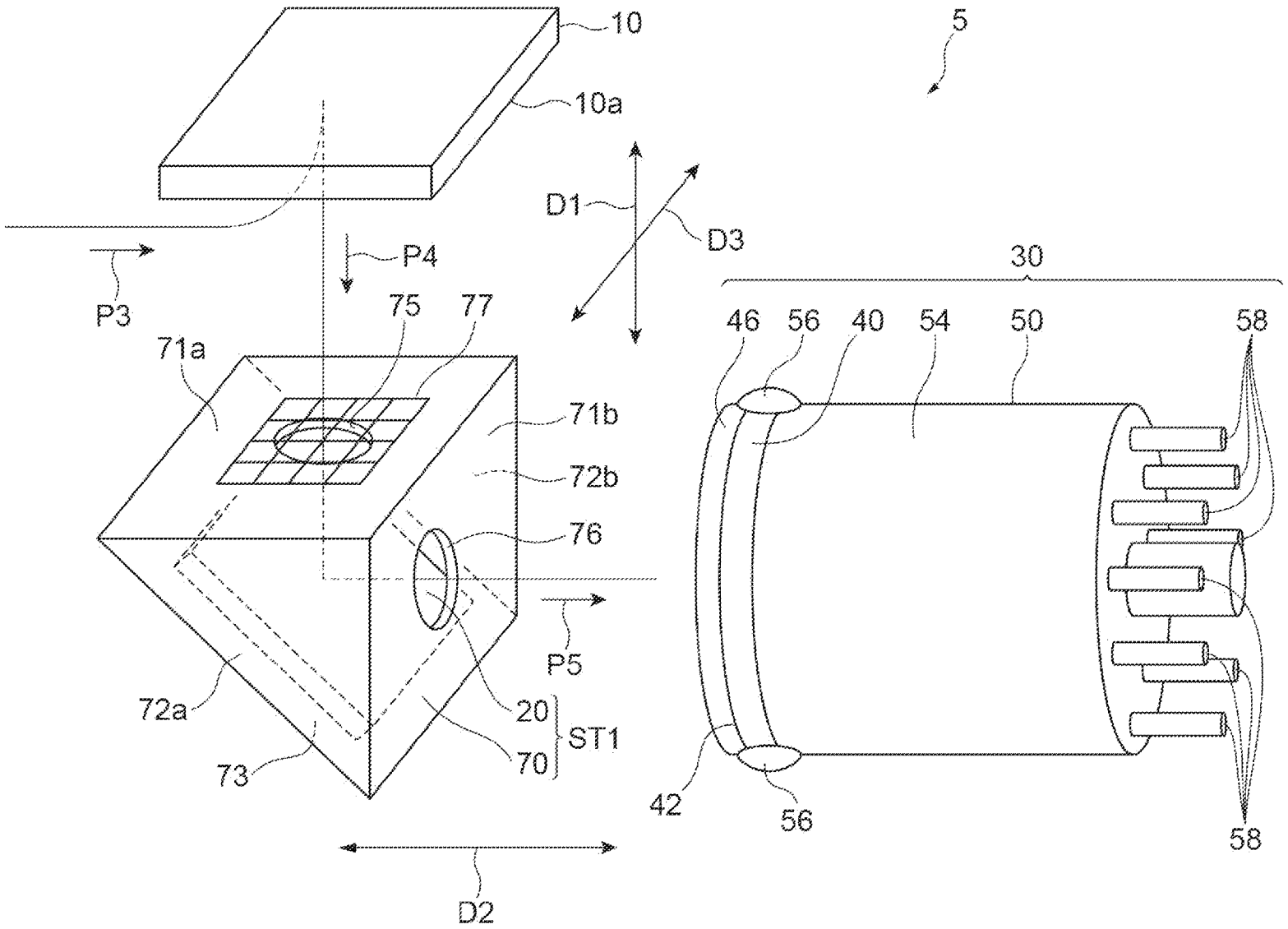
FIG. 2 is a perspective view illustrating an ion detector.
Figure 3:
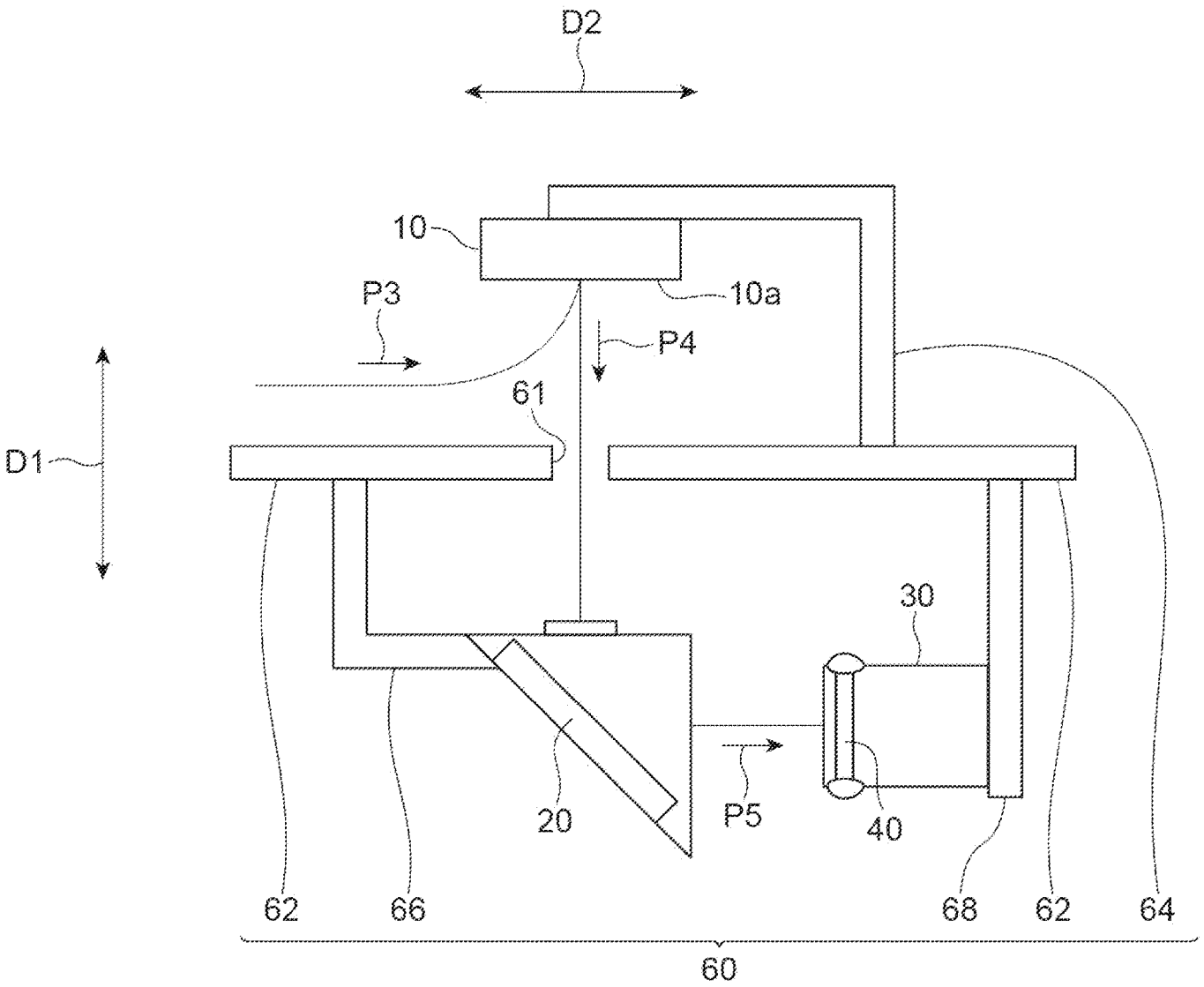
FIG. 3 is a diagram illustrating a support.
Figure 4:
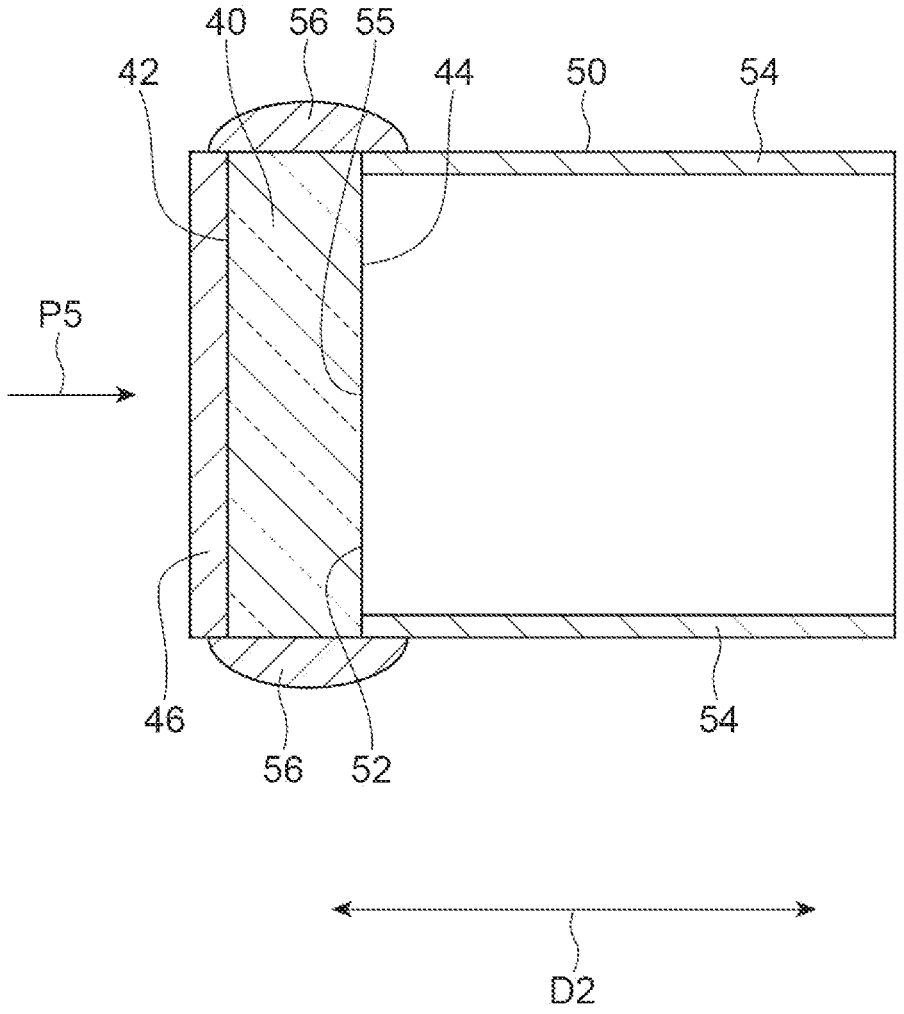
FIG. 4 is a diagram illustrating a cross-sectional configuration of a scintillator and a photomultiplier tube.
Figure 5:
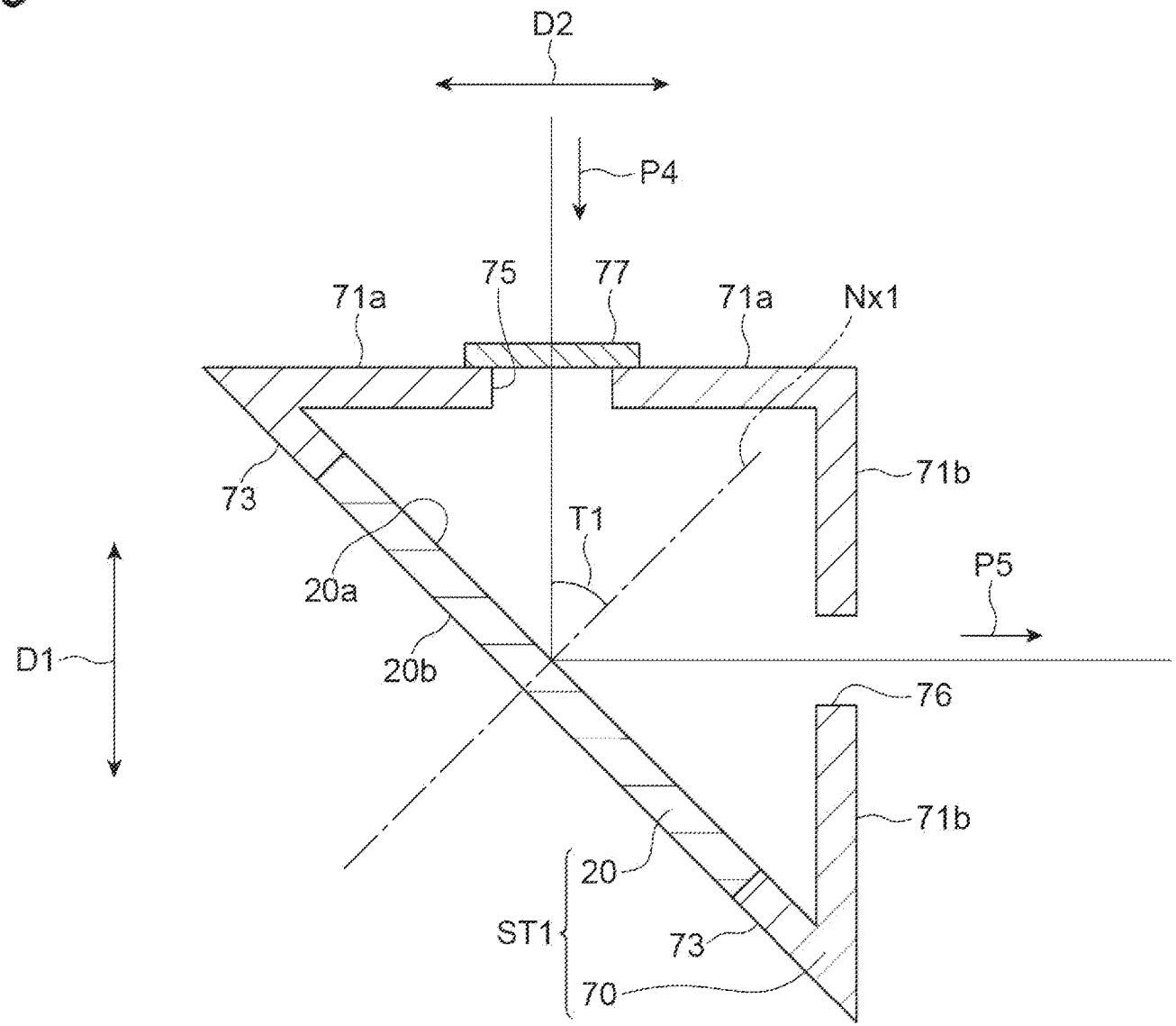
FIG. 5 is a diagram illustrating a cross-sectional configuration of a second dynode and a cover.

A configuration of a mass spectrometer 1 according to the present embodiment will be described with reference to FIGS. 1 to 5. FIG. 1 is a schematic view illustrating the mass spectrometer according to this embodiment. FIG. 2 is a perspective view illustrating an ion detector. FIG. 3 is a diagram illustrating a support. FIG. 4 is a diagram illustrating a cross-sectional configuration of a scintillator and a photomultiplier tube. FIG. 5 is a diagram illustrating a cross-sectional configuration of a second dynode and a cover.

As illustrated in FIG. 1, the mass spectrometer 1 includes a sample introduction unit 2, an ionization unit 3, a mass spectrometer unit 4, an ion detector 5, and a signal processing unit 6. The sample introduction unit 2 introduces a sample P1 into the ionization unit 3. The ionization unit 3 is configured to ionize the sample P1 introduced from the sample introduction unit 2. The ionization unit 3 introduces an ionized sample P2 into the mass spectrometer unit 4. The mass spectrometer unit 4 is configured to allow only an ion to be detected to pass among ions from the ionization unit 3. The mass spectrometer unit 4 includes, for example, a quadrupole analyzer, and allows only an ion P3 to be detected to pass through. The ion P3 to be detected is incident on the ion detector 5. The ion detector 5 detects the incident ion P3. The ion detector 5 is configured to detect the ion P3 to be detected from the mass spectrometer unit 4. The signal processing unit 6 processes a detection signal SG1 from the ion detector 5.

The mass spectrometer 1 includes a housing 7. The ionization unit 3, the mass spectrometer unit 4, and the ion detector 5 are contained in the housing 7. In this embodiment, the housing 7 includes a vacuum chamber. The mass spectrometer 1 includes a power source unit 8. The power source unit 8 supplies electric power EP1 to the ion detector 5. The power source unit 8 includes, for example, an assembly of a plurality of power sources.

As illustrated in FIGS. 2 and 3, the ion detector 5 includes a first dynode 10, a second dynode 20, a detection unit 30, and a support 60. The detection unit 30 includes a scintillator 40 and a photomultiplier tube 50. The first dynode 10 is configured to emit a charged particle P4 in response to the incidence of the ion P3 to be detected. The second dynode 20 is configured to emit a secondary electron P5 in response to the incidence of the charged particle P4 from the first dynode 10. The detection unit 30 is configured to detect the secondary electron P5 that is incident from the second dynode 20. In this embodiment, the charged particle P4 includes a positive ion or a secondary electron. In FIG. 2, the support 60 is not illustrated.

In the detection unit 30, the scintillator 40 converts the secondary electron P5 from the second dynode 20 into light. The scintillator 40 emits the converted light toward the photomultiplier tube 50. The photomultiplier tube 50 is configured to detect the light from the scintillator 40. The photomultiplier tube 50 includes a plurality of electrodes 58. Some of the plurality of electrodes 58 transmit the detection signal SG1 of the photomultiplier tube 50 to the signal processing unit 6 (see FIG. 1). Of the plurality of electrodes 58, other electrodes transmit the electric power from the power source unit 8 to the detection unit 30. The scintillator 40 and the photomultiplier tube 50 may be disposed to be spaced apart from each other, or may have a configuration in which they are integrally coupled to each other. The scintillator 40 is made of, for example, an organic material or an inorganic material. The organic material is, for example, plastic. The inorganic material is, for example, gadolinium oxysulfide, zinc oxide, or gallium nitride.

The detection unit 30 is spaced apart from the second dynode 20 in a second direction D2. A distance between the detection unit 30 and the second dynode 20 is relatively small so that the secondary electron P5 from the second dynode 20 is more reliably incident on the scintillator 40. The distance between the detection unit 30 and the second dynode 20 in the second direction D2 is, for example, 4 mm. In FIGS. 2 and 3, an example of each path through which the ion P3, the charged particle P4, and the secondary electron P5 move is illustrated with a solid line and a broken line. The ion P3, the charged particle P4, and the secondary electron P5 are schematically indicated with arrows. The arrows indicating the ion P3, the charged particle P4, and the secondary electron P5 are illustrated to be spaced apart from the above-mentioned paths in order that each arrow can be seen well on the drawing.

The support 60 supports the first dynode 10, the second dynode 20, and the detection unit 30. The support 60 includes a base 62 in which an inlet 61 is formed, and supports 64, 66, and 68 coupled with the base 62. In this embodiment, the first dynode 10 is positioned opposite side of the second dynode 20 and detection unit 30 with the base 62 being sandwiched therebetween in the first direction D1. The base 62 is made of, for example, stainless steel. The electric potential of the base 62 is set to a ground potential.

The support 64 supports the first dynode 10 to the base 62. The first dynode 10 is supported by the support 64 to emit the charged particle P4 in the first direction D1. The charged particle P4 that have passed through the inlet 61 are directed to the second dynode 20. The support 64 includes an insulating material. The support 64 electrically insulates the first dynode 10 from the base 62.

The support 66 supports the second dynode 20 to the base 62. The second dynode 20 is supported by the support 66 so that the charged particle P4 that has passed through the inlet 61 is incident. The second dynode 20 emits the secondary electron P5 in response to the incidence of the charged particle P4. The support 66 includes an insulating material. The support 66 electrically insulates the second dynode 20 from the base 62. A distance between the first dynode 10 and the second dynode 20 in the first direction D1 is, for example, 20 to 40 mm. In this embodiment, the distance between the first dynode 10 and the second dynode 20 in the first direction D1 is 23 mm or 35 mm.

The support 68 supports the detection unit 30 to the base 62. The secondary electron P5 from the second dynode 20 travels in the second direction D2 and is incident on the scintillator 40 of the detection unit 30. The scintillator 40 is disposed so that a surface on which the secondary electron P5 is incident faces the second direction D2. The support 68 includes an insulating material. The support 68 electrically insulates the detection unit 30 from the base 62. The insulating material contained in the supports 64, 66, and 68 is made of, for example, ceramics or PEEK (polyetheretherketone).

In the ion detector 5, the first dynode 10 is given a negative or positive potential by the power source unit 8 depending on whether the incident ion P3 to be detected is a positive ion or a negative ion. When the ion P3 to be detected is a positive ion, the first dynode 10 is configured to be given a negative potential by the power source unit 8. The first dynode 10 given a negative potential attracts a positive ion. The first dynode 10 converts the attracted positive ion into the secondary electron. The converted secondary electron is incident on the second dynode 20. When the ion P3 to be detected is a negative ion, the first dynode 10 is configured to be given a positive potential by the power source unit 8. The first dynode 10 given a positive potential attracts a negative ion and converts the attracted a negative ion into a positive ion. The converted positive ion is incident on the second dynode 20. The positive and negative ions as ion P3 are incident on a surface 10*a* of the first dynode 10 approximately perpendicular to the surface 10*a*. The charged particle P4 emitted from the first dynode 10 is emitted in an approximately perpendicular direction from the surface 10*a* of the first dynode 10. The first dynode 10 is, for example, an electrode made of a metal material. In this embodiment, the first dynode 10 is made of aluminum, stainless steel, or a Cu—Be alloy. The first dynode 10 has, for example, a plate shape.

The second dynode 20 is configured to be given a negative potential by the power source unit 8. When the ion P3 to be detected is a positive ion, the second dynode 20 emits the secondary electron from the first dynode 10 toward the scintillator 40. When the ion P3 to be detected is a negative ion, the second dynode 20 attracts the positive ion from the first dynode 10. The second dynode 20 converts the attracted positive ion into the secondary electron P5. The converted secondary electron P5 is incident on the scintillator 40. The second dynode 20 is, for example, an electrode made of a metal material. In this embodiment, the second dynode 20 is made of aluminum, stainless steel, or a Cu—Be alloy. The second dynode 20 has, for example, a plate shape.

The scintillator 40 is given a negative potential by the power source unit 8. When the ion P3 is a positive ion, as described above, the secondary electron converted from the positive ion by the first dynode 10 is incident on the scintillator 40. The scintillator 40 is configured to convert the secondary electron from the first dynode 10 into light. When the ion P3 is a negative ion, as described above, the secondary electron P5 converted from the positive ion by the second dynode 20 is incident on the scintillator 40. The scintillator 40 converts the secondary electron P5 incident from the second dynode 20 into light.

As illustrated in FIG. 4, in the ion detector 5, the scintillator 40 includes an electron incident surface 42 and a light exit surface 44. The ion detector 5 includes a conductive layer 46 disposed on the electron incident surface 42. A negative potential is given to the conductive layer 46 by the power source unit 8. The secondary electron P5 from the second dynode 20 is incident on the conductive layer 46 and passes through the conductive layer 46. The secondary electron P5 that has passed through the conductive layer 46 is received by the electron incident surface 42 of the scintillator 40, and enters the scintillator 40 from the electron incident surface 42. The electron incident surface 42 is arranged to receive the secondary electron P5. The scintillator 40 converts the secondary electron P5 into light. The light converted by the scintillator 40 is emitted from the light exit surface 44 toward the photomultiplier tube 50. The light exit surface 44 is arranged to emit the light converted by the scintillator 40. In this embodiment, the electron incident surface 42 and the light exit surface 44 oppose each other in the second direction D2. The conductive layer 46 is provided on the electron incident surface 42. The conductive layer 46 is, for example, a vapor deposition film made of a metal material. In this embodiment, the conductive layer 46 is made of aluminum.

The photomultiplier tube 50 detects the light from the scintillator 40. The photomultiplier tube 50 includes a side tube 54 in which an opening 52 is formed. The opening 52 is formed at one end of the side tube 54. The side tube 54 is disposed in the scintillator 40 so that the opening 52 opposes the scintillator 40. The photomultiplier tube 50 includes a light incident window 55. The light from the scintillator 40 passes through the opening 52 and is incident on the light incident window 55. The light from the light exit surface 44 is incident on the light incident window 55. The light incident window 55 is arranged to receive the light from the light exit surface 44. The light incident window 55 is disposed in the opening 52. The photomultiplier tube 50 converts the light incident on the light incident window 55 into electron. The photomultiplier tube 50 multiplies the photoelectrically converted electron. A negative potential is given to the photomultiplier tube 50 by the power source unit 8. The light incident window 55 is disposed in close proximity to the light exit surface 44 of the scintillator 40. The expression "in close proximity to" as used herein includes, for example, the following two aspects: The light incident window 55 is optically coupled to the light exit surface 44 via silicone oil or the like. A distance between the light incident window 55 and the light exit surface 44 is small.

The side tube 54 is configured to be given a cathode potential of the photomultiplier tube 50. The conductive layer 46 is electrically connected to the side tube 54. In this embodiment, a connecting body 56 made of an electrically conductive paste electrically connects the conductive layer 46 and the side tube 54. The connecting body 56 is provided to cover a boundary between the scintillator 40 and the photomultiplier tube 50. In the configuration in which the conductive layer 46 and the side tube 54 are electrically connected, the electric potential of the scintillator 40 is approximately the same as the potential of the side tube 54. In this embodiment, the scintillator 40 and the photomultiplier tube 50 constitute the detection unit 30 integrated by the connecting body 56. The emission surface 44 and the light incident window 55 are optically coupled to each other.

In the ion detector 5, the power source unit 8 changes a polarity of the electric potential given to the first dynode 10 and adjusts a magnitude of the electric potential given to the first dynode 10, the second dynode 20, and the scintillator 40, depending on whether the incident ion P3 to be detected is a positive ion or a negative ion. When the ion P3 to be detected is a positive ion, the potential given to the first dynode 10 is, for example, about −12 kV. The potential given to the second dynode 20 is, for example, about −5 kV. The potential given to the scintillator 40 is set, for example, in a range of 0 kV to −1 kV. In this embodiment, the magnitude of the negative potential given to the second dynode 20 is a magnitude between the magnitude of the negative potential given to the first dynode 10 and the magnitude of the negative potential given to the scintillator 40. The magnitude of the negative potential given to the second dynode 20 is larger than the magnitude of the negative potential given to the scintillator 40. As used herein, the "magnitude of negative potential" means an absolute value of the magnitude of the negative potential. For example, the expression "the magnitude of the negative potential given to the second dynode 20 is larger than the magnitude of the negative potential given to the scintillator 40" means that "the absolute value of the negative potential given to the second dynode 20 is larger than the absolute value of the negative potential given to the scintillator 40".

When the ion P3 to be detected is a negative ion, the electric potential given to the first dynode 10 is, for example, about 12 kV. The potential given to the second dynode 20 is, for example, about −5 kV. The potential given to the scintillator 40 is set, for example, in a range of 0 kV to −1 kV. In this embodiment, even when the ion P3 to be detected is a negative ion, the magnitude of the negative potential given to the second dynode 20 is larger than the magnitude of the negative potential given to the scintillator 40. The power source unit 8 supplies electric power to the first dynode 10, the second dynode 20, and the scintillator 40, and also supplies electric power to the photomultiplier tube 50. In this embodiment, the power source unit 8 includes an assembly of four power sources.

As illustrated in FIGS. 2 and 5, the ion detector 5 includes a cover 70 that covers the second dynode 20. The cover 70 includes a side wall 71*a*, a side wall 71*b*, a pair of end walls 72*a* and 72*b* opposing each other, and a bottom wall 73. In this embodiment, the second dynode 20 is located in the bottom wall 73 and is integrated with the cover 70. A structure ST1 in which the second dynode 20 and the cover 70 are integrated has, for example, a hollow triangular prism shape. In the structure ST1, a bottom portion 20*b* and the bottom wall 73 of the second dynode 20 constitute one side surface of the hollow triangular prism. Each of the side walls 71*a* and 71*b* constitutes another side surface of the hollow triangular prism. Each of the end walls 72*a* and 72*b* constitutes one bottom surface of the hollow triangular prism.

As illustrated in FIG. 2, in the structure ST1, the side wall 71*a* extends in a third direction D3 intersecting the first direction D1 and the second direction D2, and couples the pair of end walls 72*a* and 72*b* each other. A first passage port 75 is formed in the side wall 71*a*. The first passage port 75 is located, for example, in a central region of the side wall 71*a*. The first passage port 75 is arranged to allow the charged particle P4 from the first dynode 10 to pass therethrough. In the structure ST1, the side wall 71*b* extends in the third direction D3 and couples the pair of end walls 72*a* and 72*b* each other. A second passage port 76 is formed in the side wall 71*b*. The second passage port 76 is located, for example, in a central region of the side wall 71*b*. The second passage port 76 is arranged to allow the secondary electron P5 from the second dynode 20 to pass therethrough. The charged particle P4 from the first dynode 10 passes through the inlet 61. The charged particle P4 that has passed through the inlet 61 passes through the first passage port 75 and is incident on the second dynode 20. The secondary electron P5 from the second dynode 20 passes through the second passage port 76 and is incident on the detection unit 30.

The ion detector 5 includes a mesh 77 that covers the first passage port 75. The mesh 77 is given a negative potential. The electric potential given to the mesh 77 is, for example, the same potential as the potential given to the second dynode 20. The potential given to the mesh 77 is, for example, about −5 kV. Since the potential of the base 62 is set to the ground potential, the potential given to the mesh 77 is lower than the potential of the base 62. The mesh 77 is made of, for example, a metal material. In this embodiment, the mesh 77 is made of stainless steel.

As illustrated in FIG. 5, the second dynode 20 is disposed to intersect the first direction D1. The charged particle P4 from the first dynode 10 is obliquely incident on a surface 20*a* of the second dynode 20. The incident angle T1 of the charged particle P4 on the surface 20*a* is defined as an angle formed by an incidence direction of the charged particle P4 and a normal direction Nx1 of the surface 20*a*. In this embodiment, the incident direction of the charged particle P4 is the first direction D1. The incident angle T1 is, for example, about 22.5 degrees. In FIG. 5, an example of each path through which the charged particle P4 and the secondary electron P5 move is illustrated by a solid line. The charged particle P4 and the secondary electron P5 are schematically indicated with arrows. The arrows indicating the charged particle P4 and the secondary electron P5 are illustrated to be spaced apart from the above-mentioned paths in order that each arrow can be seen well on the drawing.

Figure 6:
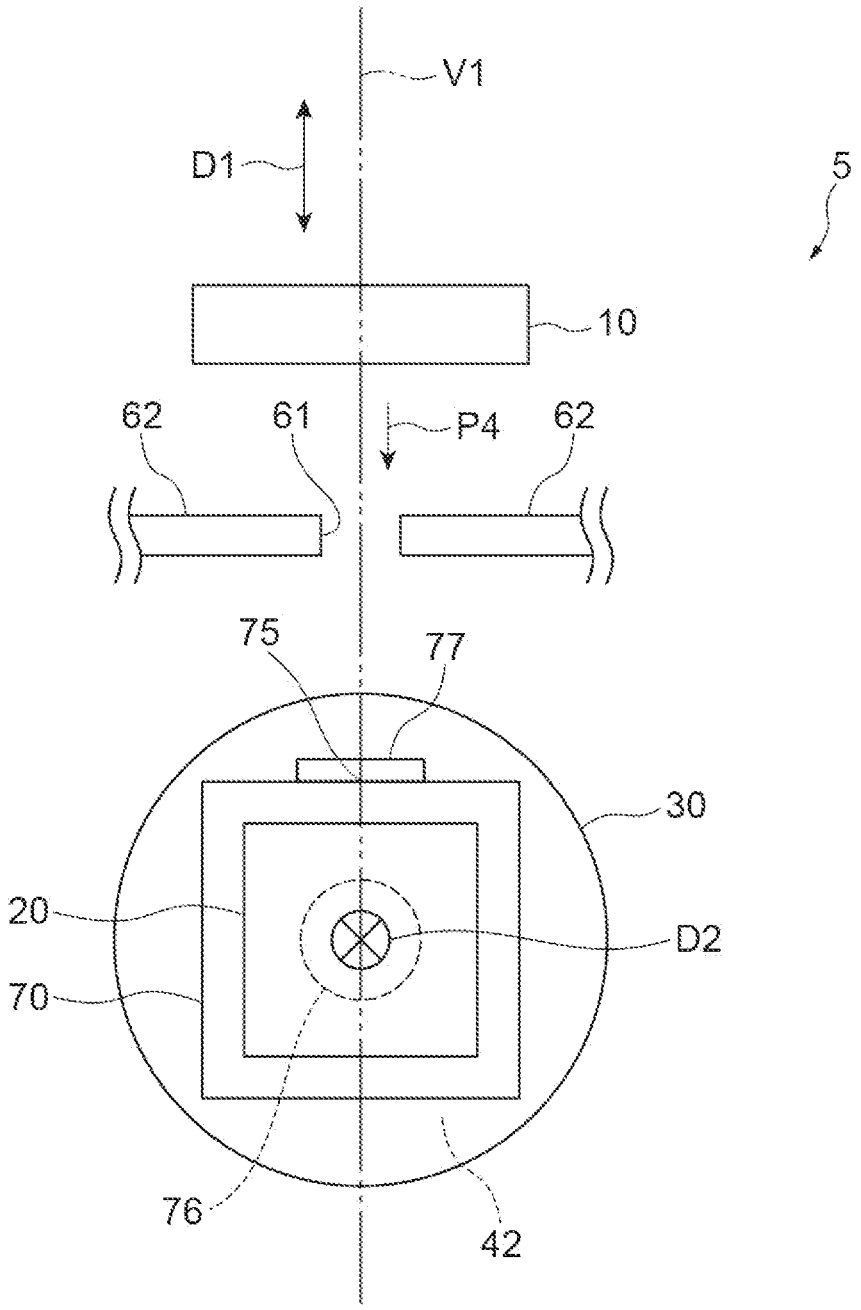
FIG. 6 is a diagram illustrating the ion detector.

Next, a layout of the ion detector 5 according to the embodiment will be described with reference to FIGS. 2 and 6. FIG. 6 is a layout diagram of the ion detector 5 when viewed in the second direction D2. As illustrated in FIGS. 2 and 6, the charged particle P4 from the first dynode 10 is incident on the second dynode 20 in the first direction D1. The secondary electron P5 from the second dynode 20 is incident on the detection unit 30 in the second direction D2. In FIG. 6, a virtual plane V1 is illustrated by a chain double-dashed line, and the virtual plane V1 is defined as a plane including the second dynode 20, the second passage port 76, and the electron incident surface 42. In this embodiment, the first direction D1 and the second direction D2 are included in the virtual plane V1. The first dynode 10, the inlet 61, and the first passage port 75 are located in the virtual plane V1. The charged particle P4 from the first dynode 10 passes through the inlet 61 and the first passage port 75 in this order along the virtual plane V1. The charged particle P4 that has passed through the first passage port 75 is incident on the second dynode 20. The secondary electron P5 from the second dynode 20 is incident on the detection unit 30 along the virtual plane V1. In FIG. 6, the charged particle P4 is schematically illustrated with an arrow. An example of the path of movement of the charged particle P4 corresponds to a chain double-dashed line displaying the virtual plane V1 when viewed in the second direction D2. The arrow indicating the charged particle P4 is illustrated to be spaced apart from the chain double-dashed line displaying the virtual plane V1 in order that the arrow can be seen well on the drawing.

Figure 7:
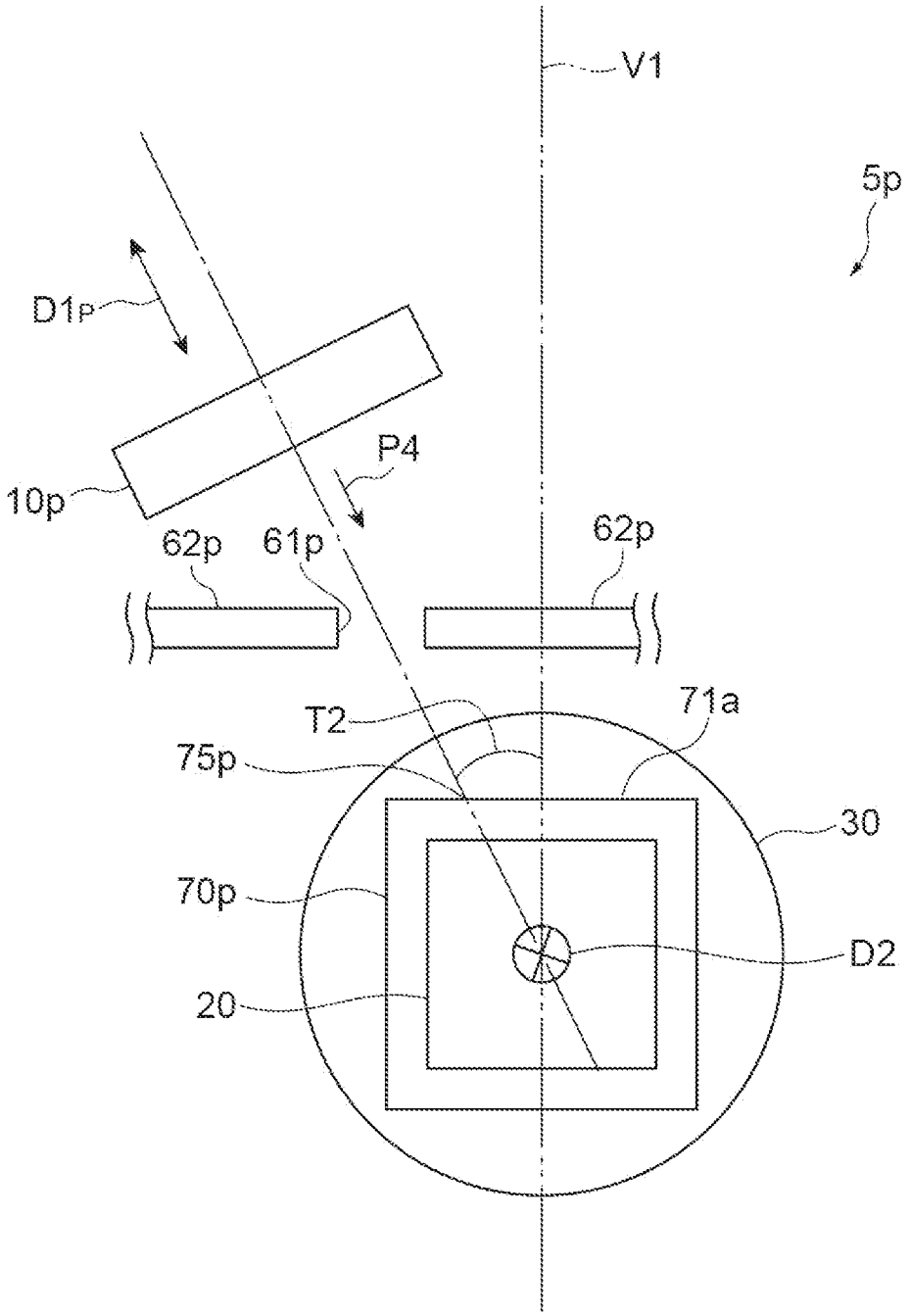
FIG. 7 is a diagram illustrating a first modification of the ion detector.

FIG. 7 is a layout diagram of an ion detector 5*p* according to a first modification when viewed in the second direction D2, and corresponds to the layout diagram of FIG. 6. In FIG. 7, the incident direction of the secondary electron P5 from the second dynode 20 to the detection unit 30 coincides with the incident direction of the secondary electron P5 illustrated in FIG. 6. Even in the ion detector 5*p*, the second dynode 20 and the detection unit 30 are disposed on the virtual plane V1. However, in the ion detector 5*p*, positions of a first dynode 10*p*, an inlet 61*p*, and a first passage port 75*p* are different from the positions in FIG. 6. The ion detector 5*p* also does not include a mesh that covers the first passage port 75*p*. In the description of this modification, a reference numeral in which "p" is added to the reference numeral used in the above-described embodiment is used for the element having the same configuration or function as the element provided in the ion detector 5, and the description is omitted as much as possible.

In this modification, the first dynode 10*p*, the inlet 61*p*, and the first passage port 75*p* are spaced apart from the virtual plane V1. The first dynode 10*p* is disposed in a direction D1*p* intersecting the virtual plane V1. The inlet 61*p* is provided between the first dynode 10*p* and the second dynode 20 and located in the direction D1*p*. The first passage port 75*p* is located in the side wall 71*a* in the direction D1*p*. The first passage port 75*p* is formed, for example, in a peripheral region of the side wall 71*a*. The charged particle P4 from the first dynode 10*p* passes through the inlet 61*p* and the first passage port 75*p* in this order. The charged particle P4 that has passed through the first passage port 75*p* is incident on the second dynode 20 in the direction D1*p*. In FIG. 7, the charged particle P4 is schematically illustrated with an arrow. An example of the path of movement of the charged particle P4 corresponds to a dashed line displaying the direction D1*p*. The arrow indicating the charged particle P4 is illustrated to be spaced apart from the dashed line displaying direction D1*p* in order that the arrow can be seen well on the drawing.

In the ion detector 5*p*, none of the first dynode 10*p*, the inlet 61*p*, and the first passage port 75*p* are located in the virtual plane V1. The first passage port 75*p* is not formed in the side wall 71*a* located in the virtual plane V1. The secondary electron P5 from the second dynode 20 tends not to be affected by the ground potential of the base 62, and are incident on the detection unit 30 along the virtual plane V1. In the ion detector 5*p*, the mesh does not have to be placed at the first passage port 75*p*. Even if the mesh is not disposed at the first passage port 75*p*, the secondary electron P5 tends not to pass through the first passage port 75*p*. In the modification, an angle T2 formed by the direction D1*p* and the virtual plane V1 is about 45 degrees. The ion detector 5*p* may include a mesh that covers the first passage port 75*p*.

As described above, in the present embodiment and the modification, the ion detectors 5 and 5*p* include the scintillator 40 and the photomultiplier tube 50 configured to detect the light emitted from the scintillator 40. The ion detectors 5 and 5*p* include the first and second dynodes 10, 10*p*, and 20. The first dynodes 10 and 10*p* emit the charged particle P4 in response to the incidence of the ion P3. The second dynode 20 emits the secondary electron P5 in response to the incidence of the charged particle P4 from the first dynodes 10 and 10*p*. The secondary electron P5 from the second dynode 20 is incident on the scintillator 40. The scintillator 40 converts the incident secondary electron P5 into light even in a case the given electric potential is low. Since the potential given to the scintillator 40 is possibly set low, the life-span of the ion detector 5 is extended.

In the ion detectors 5 and 5*p*, the scintillator 40 includes the light exit surface 44 arranged to emit light. The photomultiplier tube 50 includes the light incident window 55 arranged to receive the light from the light exit surface 44. The light exit surface 44 is disposed in close proximity to the light incident window 55.

In this case, optical loss of the light incident on the photomultiplier tube 50 from the scintillator 40 is reduced. Even in a case the electric potential given to the photomultiplier tube 50 is low, photodetection sensitivity in the photomultiplier tube 50 is ensured.

In the ion detectors 5 and 5*p*, the first dynodes 10 and 10*p* are configured to be given a negative potential to convert a positive ion into the secondary electron P5, and the second dynode 20 is configured to allow the secondary electron P5 from the first dynodes 10 and 10*p* to be incident on the electron incident surface 42 of the scintillator 40, in the ion detectors 5 and 5*p* configured to detect the positive ion.

In this case, the positive ion incident on the ion detectors 5 and 5*p* is converted into the secondary electron P5 by the first and second dynodes 10 and 20. The converted secondary electron P5 is incident on the scintillator 40. The scintillator 40 reliably converts the incident secondary electron P5 into light even in a case the given electric potential is low.

In the ion detectors 5 and 5*p*, the first dynodes 10 and 10*p* are configured to be given a positive potential to convert a negative ion into a positive ion, and the second dynode 20 is configured to convert the positive ion from the first dynodes 10 and 10*p* into the secondary electron P5 and allow the secondary electron P5 to be incident on the electron incident surface 42 of the scintillator 40, in the ion detectors 5 and 5*p* configured to detect the negative ion.

In this case, the negative ion incident on the ion detectors 5 and 5*p* is converted into the secondary electron P5 by the first and second dynodes 10, 10*p*, and 20. The secondary electron P5 from the second dynode 20 is incident on the scintillator 40. The scintillator 40 reliably converts the incident secondary electron P5 into light even in a case the given electric potential is low.

In the ion detectors 5 and 5*p*, the scintillator 40 is configured to be given a negative potential. The second dynode 20 is configured to be given the negative potential whose magnitude is larger than a magnitude of the negative potential given to the scintillator 40.

In this case, the scintillator 40 is given an electric potential lower than the magnitude of the negative potential given to the second dynode 20.

In the ion detectors 5 and 5*p*, the second dynode 20 is configured to be given a negative potential whose magnitude is between a magnitude of the negative potential given to the first dynode 10 and a magnitude of the negative potential given to the scintillator 40, in the ion detectors 5 and 5*p* configured to detect a positive ion.

In this case, the second dynode 20 is given an electric potential lower than the magnitude of the negative potential given to the first dynodes 10 and 10*p*.

In the ion detectors 5 and 5*p*, the photomultiplier tube 50 includes the side tube 54 configured to be given a cathode potential. The electrically conductive layer 46 is electrically connected to the side tube 54.

In this case, the electric potential of the scintillator 40 is approximately the same as the cathode potential of the photomultiplier tube 50. A single power source may supply electric power to the scintillator 40 and the photomultiplier tube 50. The number of power supplies is reduced.

The ion detectors 5 and 5*p* include covers 70 and 70*p* covering the second dynode 20. The covers 70 and 70*p* include the first passage ports 75 and 75*p* arranged to allow the charged particle P4 from the first dynodes 10 and 10*p* to pass therethrough and the second passage port 76 arranged to allow the secondary electron P5 from the second dynode 20 to pass therethrough.

In this case, the secondary electron P5 emitted from the second dynode 20 is more reliably directed to the scintillator 40.

The ion detector 5 includes the mesh 77 covering the first passage port 75 and being configured to be given a negative potential.

In this case, the mesh 77 reduces that the secondary electron P5 passes through the first passage port 75 and is directed from the second dynode 20 to the first dynode 10. The secondary electron P5 emitted from the second dynode 20 is more reliably directed to the scintillator 40.

In the ion detector 5*p*, the first dynode 10*p* is disposed to be spaced apart from the virtual plane V1 including the second dynode 20, the second passage port 76, and the electron incident surface 42 of the scintillator 40. The first dynode 10*p* is configured to allow the charged particle P4 from the first dynode 10*p* to be incident on the second dynode 20 from a direction D1*p* intersecting the virtual plane V1.

In this case, the secondary electron P5 emitted from the second dynode 20 tends not to be directed to the first dynode 10*p*. The secondary electron P5 emitted from the second dynode 20 more reliably tends to be directed to the scintillator 40.

The mass spectrometer 1 includes the ion detectors 5 and 5*p* having a long life-span. The life-span of the mass spectrometer 1 is extended.

Figure 8:
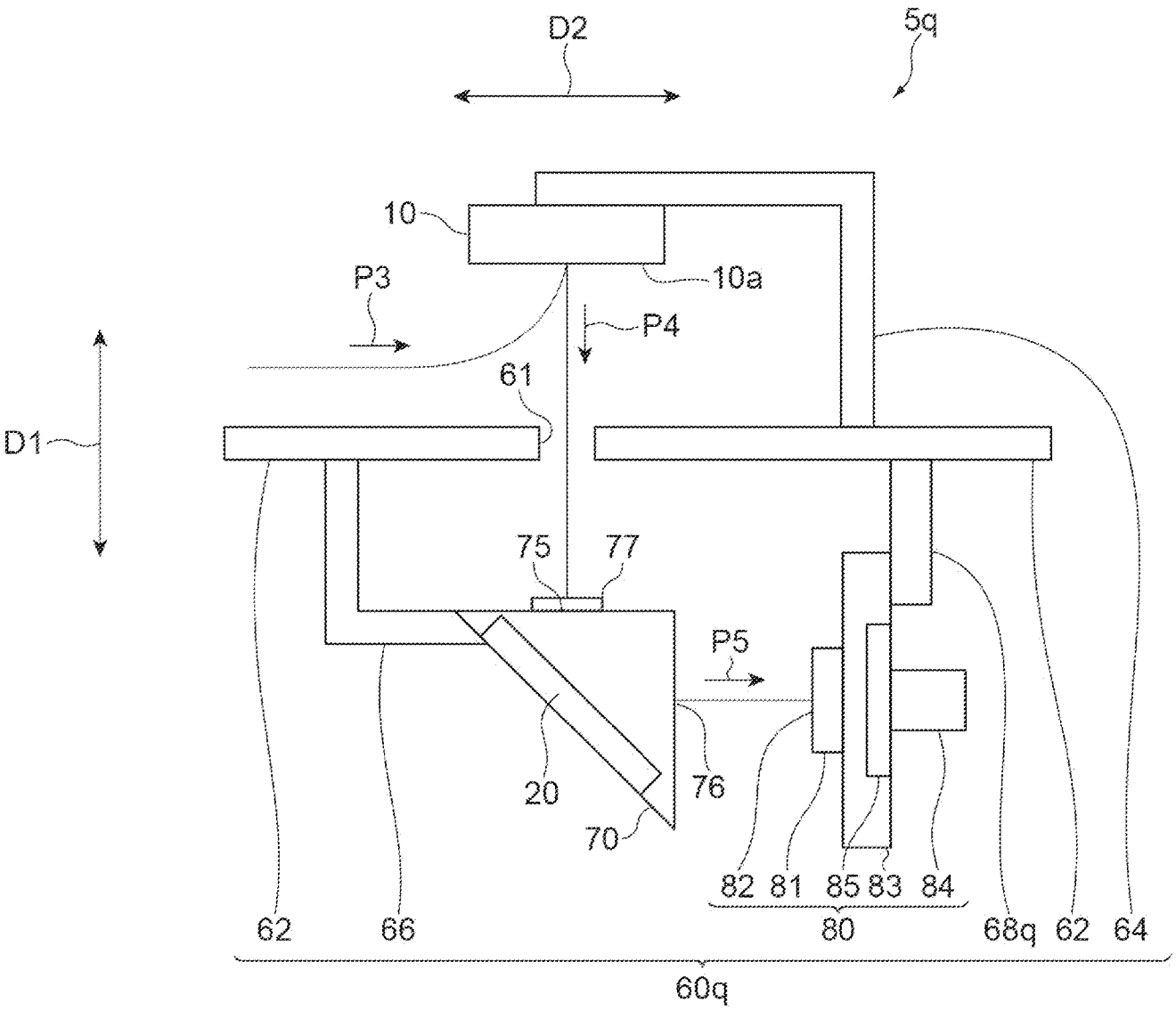
FIG. 8 is a diagram illustrating a second modification of the ion detector.

FIG. 8 is a diagram illustrating an ion detector 5*q* according to a second modification, and corresponds to FIG. 3 illustrating the ion detector 5. The ion detector 5*q* includes the first dynode 10, the second dynode 20, a detection unit 80, and a support 60*q*. The detection unit 80 is configured to detect the incident secondary electron P5, and in this modification, the detection unit 80 includes a diode 81. The diode 81 is configured to capture an emitted electron and generate an electric signal (detection signal SG1) from the acquired electron. In this modification, the diode 81 is an avalanche diode. The diode 81 may be a diode other than the avalanche diode. For example, the diode 81 may be a normal diode that does not utilize avalanche multiplication. The ion detector 5*q* differs from the ion detector 5 in terms of the configuration of the detection unit 80 and the support 60*q*. Hereinafter, differences between the ion detector 5 and the ion detector 5*q* will be mainly described.

The diode 81 includes an electron incident surface 82 arranged to receive the secondary electron P5 from the second dynode 20. The diode 81 is configured to detect the secondary electron P5 that is incident on the electron incident surface 82. The detection unit 80 includes a substrate 83 and a coaxial connector 84. The diode 81 is disposed on the substrate 83. A drive circuit 85 that drives the diode 81 is disposed on the substrate 83. The drive circuit 85 is disposed, for example, on the coaxial connector 84 side of the substrate 83. The drive circuit 85 is disposed, for example, in a portion of the substrate 83 closer to the coaxial connector 84. The drive circuit 85 may be disposed on the diode 81 side of the substrate 83. The drive circuit 85 may be disposed, for example, in a portion of the substrate 83 closer to the diode 81. The substrate 83 is made of, for example, epoxy glass. In this modification, the epoxy glass includes FR-4 (Flame Retardant Type 4). The detection signal SG1 generated by the diode 81 is transmitted to the signal processing unit 6 via the coaxial connector 84 (see FIG. 1).

The detection unit 80 is spaced apart from the second dynode 20 in the second direction D2. A distance between the detection unit 80 and the second dynode 20 is relatively small so that the secondary electron P5 from the second dynode 20 is more reliably incident on the electron incident surface 82. The distance between the detection unit 80 and the second dynode 20 in the second direction D2 is, for example, 1 to 10 mm. An effective aperture of the electron incident surface 82 has a diameter of, for example, 0.5 to 5 mm.

The support 60*q* supports the first dynode 10, the second dynode 20, and the detection unit 80. Of the support 60*q*, the base 62 and the supports 64 and 66 have the same configuration and the same material as those in the present embodiment. The first dynode 10 is positioned opposite side of the second dynode 20 and detection unit 80 with the base 62 being sandwiched therebetween in the first direction D1. A support 68*q* supports the detection unit 80 to the base 62. In this modification, the support 68*q* is connected to the substrate 83. The detection unit 80 is disposed so that the electron incident surface 82 of the diode 81 faces the second direction D2. The support 68*q* includes an insulating material. The support 68*q* electrically insulates the detection unit 80 from the base 62. The material of the support 68*q* is the same as the material of the support 68.

In the ion detector 5*q*, when the ion P3 to be detected is a positive ion, the electric potential given to the first dynode 10 is, for example, about −12 kV. The potential given to the second dynode 20 is, for example, about −5 kV. The potential given to the electron incident surface 82 of the diode 81 is set, for example, in a range of −1 kV to +15 kV. When the ion P3 to be detected is a negative ion, the potential given to the first dynode 10 is, for example, about 12 kV. The potential given to the second dynode 20 is, for example, about −5 kV. In the configuration in which the diode 81 is the avalanche diode, the potential given to the electron incident surface 82 of the diode 81 is set, for example, in the range of −1 kV to +15 kV. The power source unit 8 (see FIG. 1) supplies electric power to the first dynode 10, the second dynode 20, and the diode 81. The power source unit 8 supplies electric power to the diode 81 via the drive circuit 85. In the configuration in which the diode 81 is the normal diode described above, the potential given to the electron incident surface 82 of the diode 81 is set, for example, in the range of −1 kV to +15 kV even when the ion P3 to be detected is either a positive ion or a negative ion. In this modification, a positive potential can be given to the diode 81. In this case, focusing properties of the secondary electron P5 incident on the electron incident surface 82 are improved.

Figure 9:
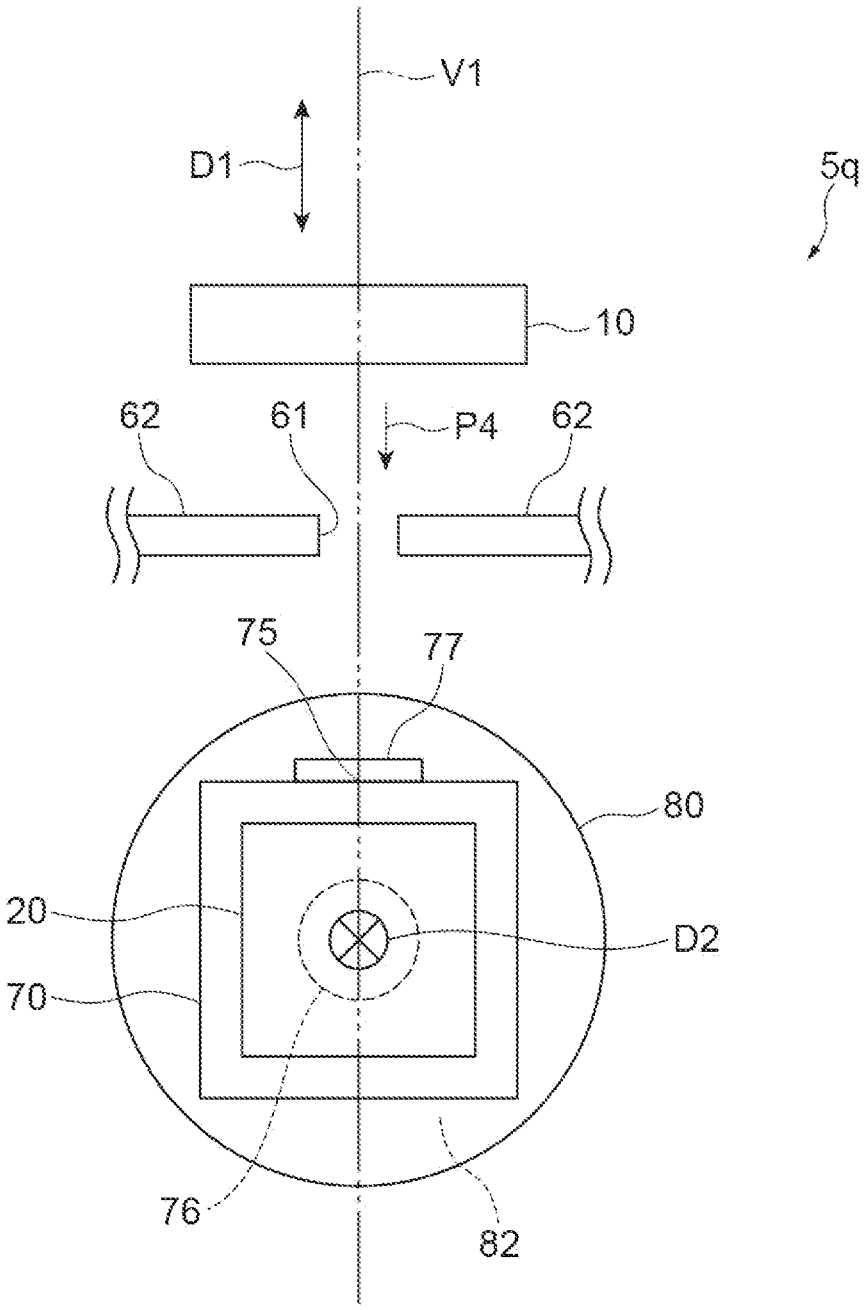
FIG. 9 is a diagram illustrating the second modification of the ion detector.

FIG. 9 is a layout diagram of the ion detector 5*q* when viewed in the second direction D2 and corresponds to FIG. 6 illustrating the layout of the ion detector 5 when viewed in the second direction D2. In FIG. 9, the ion detector 5*q* differs from the ion detector 5 in terms of the configuration of the detection unit 80. In the ion detector 5*q*, the first dynode 10, the inlet 61, and the first passage port 75 are located in the virtual plane V1. The virtual plane V1 is defined as a plane including the second dynode 20, the second passage port 76, and the electron incident surface 82. The charged particle P4 from the first dynode 10 passes through the inlet 61 and the first passage port 75 in this order along the virtual plane V1. The charged particle P4 that has passed through the first passage port 75 is incident on the second dynode 20. The secondary electron P5 from the second dynode 20 is incident on the detection unit 80 along the virtual plane V1.

Figure 10:
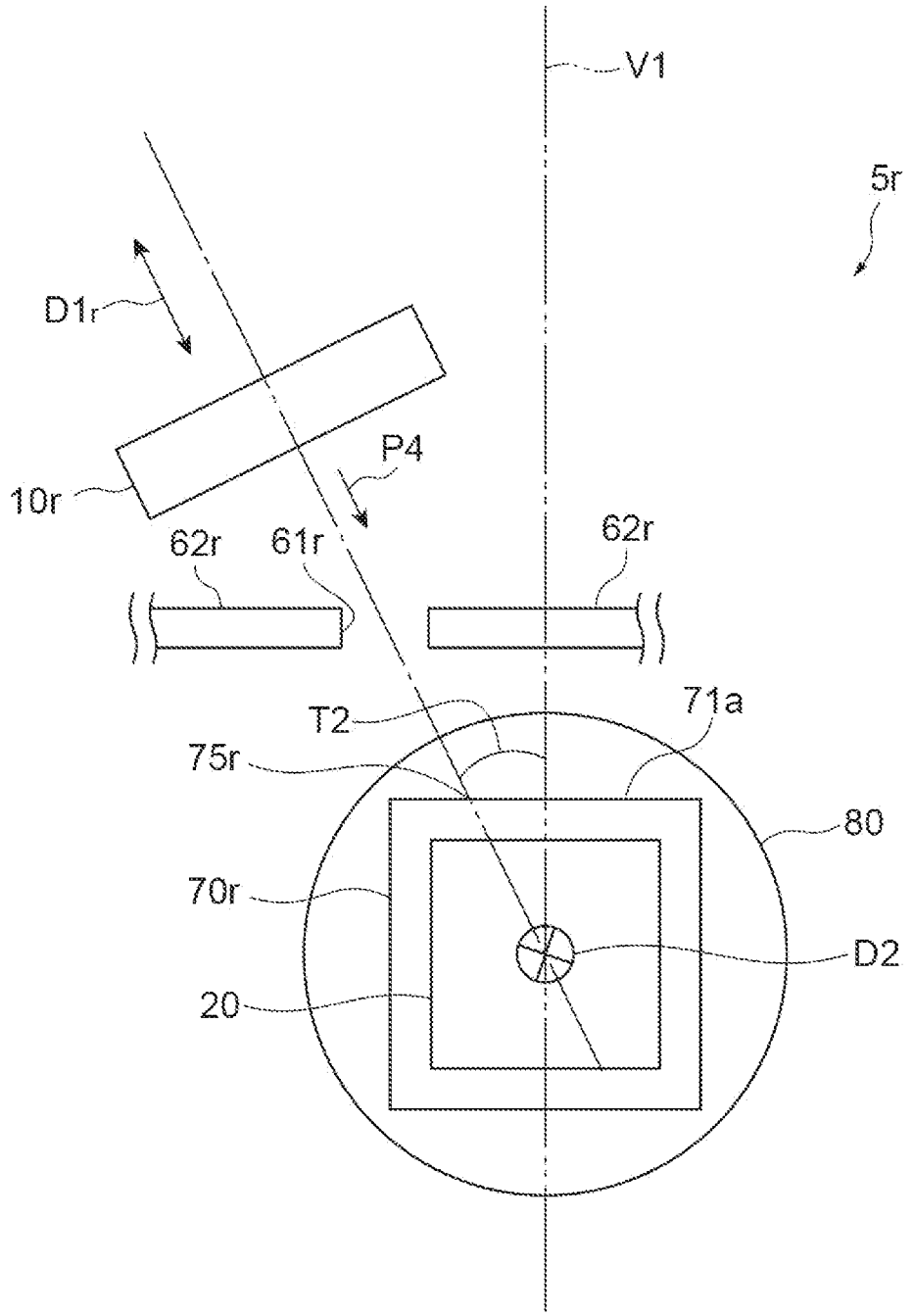
FIG. 10 is a diagram illustrating a third modification of the ion detector.

FIG. 10 is a layout diagram of an ion detector 5*r* according to a third modification when viewed in the second direction D2, and corresponds to the layout diagram of FIG. 7. The ion detector 5*r* differs from the ion detector 5*p* of FIG. 7 in terms of the configuration of the detection unit 80. Except for the detection unit 80, the configuration of the ion detector 5*r* is the same as the configuration of the ion detector 5*p*. In the description of this modification, for the element having the same configuration or function as the element provided in the ion detector 5*p*, the reference numeral "p" used for the description in the ion detector 5*p* described above is changed to a reference numeral "r", and the description is omitted as much as possible. A first dynode 10*r* is disposed to be spaced apart from the virtual plane V1. The charged particle P4 from the first dynode 10*r* is incident on the second dynode 20 from a direction D1*r* intersecting the virtual plane V1. The second dynode 20 and the detection unit 80 are disposed in the virtual plane V1.

Figure 11:
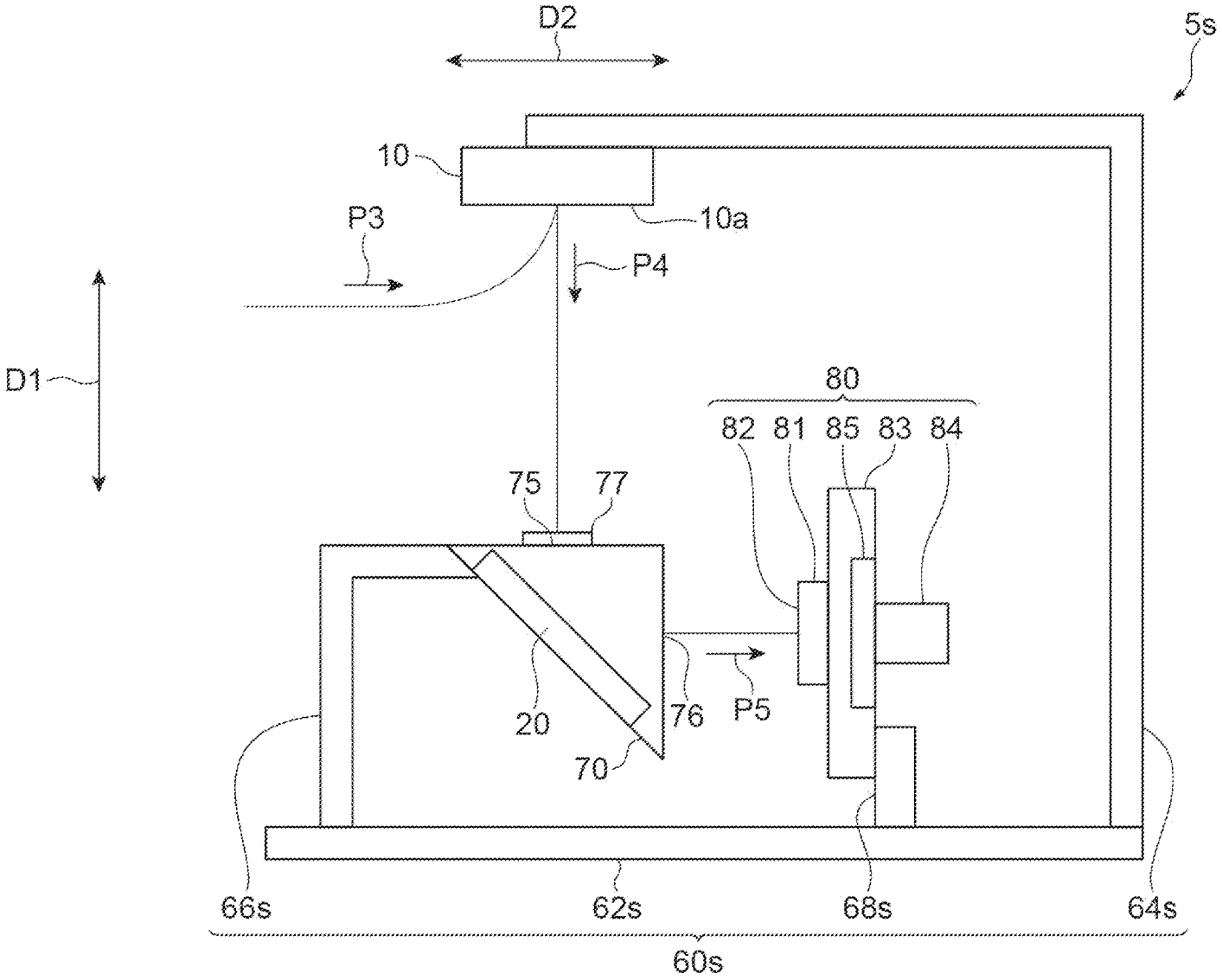
FIG. 11 is a diagram illustrating a fourth modification of the ion detector.

FIG. 11 is a diagram illustrating an ion detector according to a fourth modification. An ion detector 5*s* according to this modification includes the first dynode 10, the second dynode 20, the detection unit 80, and a support 60*s*. The ion detector 5*s* differs from the ion detector 5*q* in terms of the configuration of the support 60*s*. Hereinafter, differences between the ion detector 5*q* and the ion detector 5*s* will be mainly described.

The support 60*s* supports the first dynode 10, the second dynode 20, and the detection unit 80. The support 60*s* includes a base 62*s* and supports 64*s*, 66*s*, and 68*s* connected to the base 62*s*. In this modification, the first dynode 10, the second dynode 20, and the detection unit 80 are located on the same side with respect to the base 62*s* in the first direction D1. The electric potential of the base 62*s* is set to a ground potential. No inlet is formed in the base 62*s*.

The support 64*s* supports the first dynode 10 to the base 62*s*. The first dynode 10 is supported by the support 64*s* to emit the charged particle P4 in the first direction D1. The charged particle P4 is directed to the second dynode 20. The support 64*s* includes an insulating material. The support 64*s* electrically insulates the first dynode 10 from the base 62*s*.

The support 66*s* supports the second dynode 20 to the base 62*s*. The second dynode 20 is supported by the support 66*s* so that the charged particle P4 from the first dynode 10 is incident. The second dynode 20 emits the secondary electron P5 in response to the incidence of the charged particle P4. The support 66*s* includes an insulating material. The support 66*s* electrically insulates the second dynode 20 from the base 62*s*. The distance between the first dynode 10 and the second dynode 20 in the first direction D1 is, for example, 1 to 10 mm.

The support 68*s* supports the detection unit 80 to the base 62*s*. In this modification, the support 68*s* is connected to the substrate 83. The secondary electron P5 from the second dynode 20 travels in the second direction D2 and is incident on the diode 81 of the detection unit 80. The detection unit 80 is disposed so that the electron incident surface 82 faces the second direction D2. The support 68*s* includes an insulating material. The support 68*s* electrically insulates the detection unit 80 from the base 62*s*. The materials of the base 62*s* and the supports 64*s*, 66*s*, and 68*s* are the same as the materials of the base 62 and the supports 64, 66, and 68, respectively.

In the ion detector 5*s*, when the ion P3 to be detected is a positive ion, the electric potential given to the first dynode 10 is, for example, about −12 kV. The potential given to the second dynode 20 is, for example, about −5 kV. The potential given to the electron incident surface 82 of the diode 81 is set, for example, in a range of −1 kV to +15 kV. When the ion P3 to be detected is a negative ion, the potential given to the first dynode 10 is, for example, about 12 kV. The potential given to the second dynode 20 is, for example, about −5 kV. In the configuration in which the diode 81 is the avalanche diode, the potential given to the electron incident surface 82 of the diode 81 is set, for example, in the range of −1 kV to +15 kV. In the configuration in which the diode 81 is the normal diode described above, the potential given to the electron incident surface 82 of the diode 81 is set, for example, in the range of −1 kV to +15 kV even when the ion P3 to be detected is either a positive ion or a negative ion. In this modification, a positive potential can be given to the diode 81. In this case, focusing properties of the secondary electron P5 incident on the electron incident surface 82 are improved.

Figure 12:
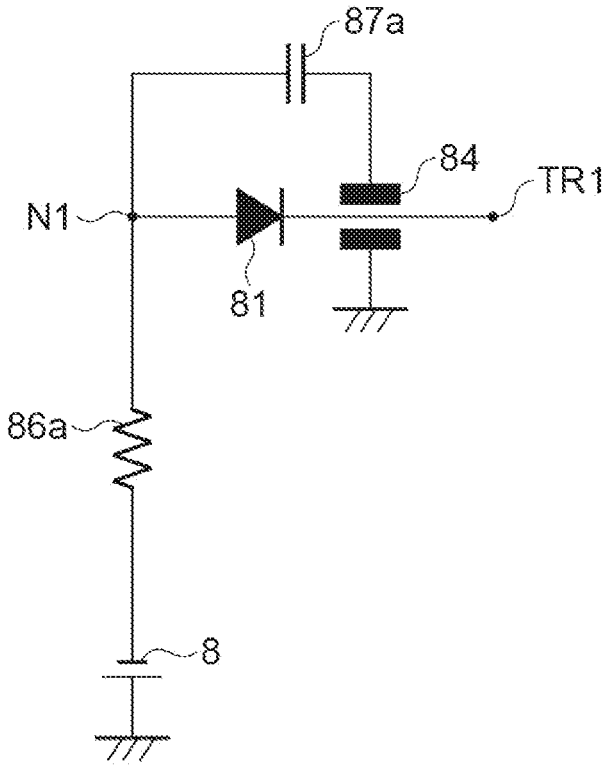
FIG. 12 is a diagram illustrating an equivalent circuit of a drive circuit of a diode.

As illustrated in FIG. 12, the drive circuit 85 includes, for example, the diode 81, a resistor 86*a*, a capacitor 87*a*, and the coaxial connector 84. FIG. 12 is a diagram illustrating an equivalent circuit of the drive circuit of the diode. The coaxial connector 84 includes an SMA (Subminiature version A) jack. In the example of the equivalent circuit illustrated in FIG. 12, the coaxial connector 84 includes the SMA (Subminiature version A) jack. The drive circuit 85 receives power supply from the power source unit 8. An anode of the diode 81 is electrically connected to the power source unit 8 via the resistor 86*a*. The diode 81 includes the anode on the electron incident surface 82 side. A cathode of the diode 81 is electrically connected to a signal output terminal TR1. The signal output terminal TR1 is electrically connected to the signal processing unit 6 (see FIG. 1). The potential of the power source unit 8 is, for example, −350 V. In a case the magnitude of the negative potential given to the second dynode 20 can be increased, the detection unit 80 tends to detect the secondary electron P5. An electrical resistance value of the resistor 86*a* is, for example, 1 kΩ.

In the drive circuit 85, a node N1 is electrically connected to a side surface of the coaxial connector 84 via the capacitor 87*a*. The node N1 is located between the diode 81 and the resistor 86*a*. The side surface of the coaxial connector 84 is grounded. The node N1 constitutes a return path. The capacitor 87*a* and the diode 81 are electrically connected in parallel. The return path is formed between the electron incident surface 82 of the diode 81 and the side surface of the coaxial connector 84. In the capacitor 87*a*, in a case the detection signal SG1 is a high-speed signal, the high-speed detection signal SG1 returns to the diode 81 with low impedance via the return path. A capacity of the capacitor 87*a* is, for example, 10 nF. The drive circuit 85 in the configuration in which the avalanche diode is used as the diode 81 and the drive circuit 85 in the configuration in which the above-mentioned ordinary diode is used as the diode 81 have the same equivalent circuit. The resistor 86*a* and the capacitor 87*a* constitute a low-pass filter. In a case an AC component from the power source unit 8 includes ripple noise, the ripple noise may deteriorate the detection signal SG1 output from the diode 81 to the signal output terminal TR1. The low-pass filter formed by the resistor 86*a* and the capacitor 87*a* removes the AC component including the ripple noise. The low-pass filter formed by the resistor 86*a* and the capacitor 87*a* reduces the deterioration of the detection signal SG1.

Figure 13:
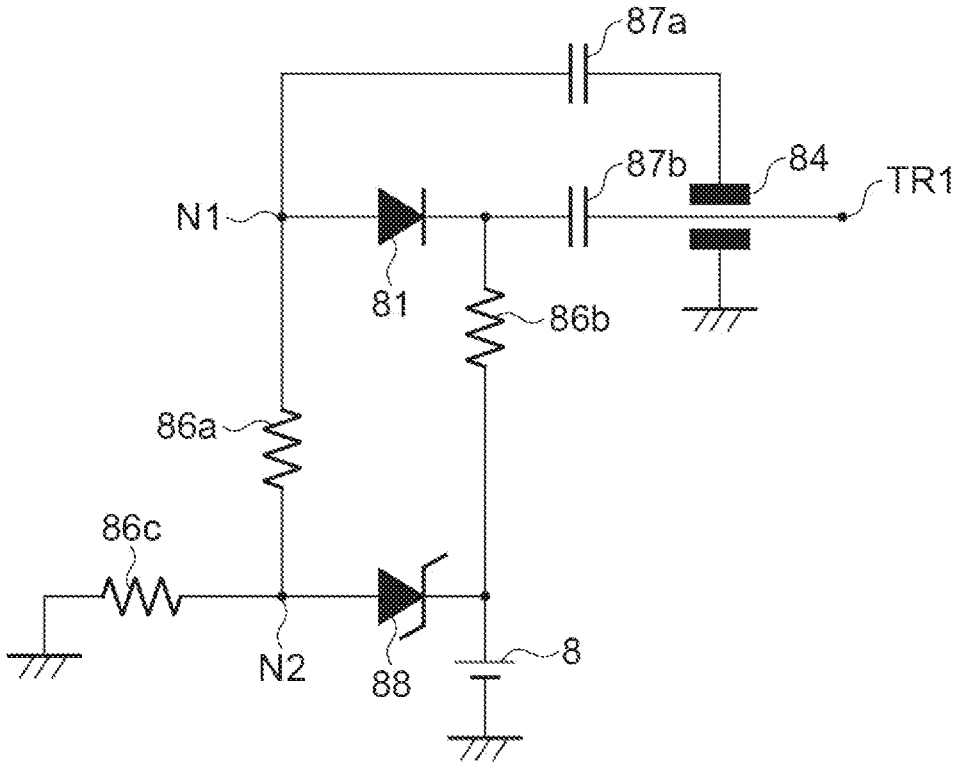
FIG. 13 is a diagram illustrating an equivalent circuit of the drive circuit of the diode.

As illustrated in FIG. 13, the drive circuit 85 includes, for example, the diode 81, a Zener diode 88, resistors 86*a*, 86*b*, and 86*c*, capacitors 87*a* and 87*b*, and the coaxial connector 84. FIG. 13 is a diagram illustrating an equivalent circuit of the drive circuit of the diode. The anode of the diode 81 is electrically connected to the power source unit 8 via the Zener diode 88 and the resistor 86*a*. The diode 81 includes the anode on the electron incident surface 82 side. The potential of the power source unit 8 is, for example, 10.35 kV. The cathode of the diode 81 is electrically connected to the power source unit 8 via the resistor 86*b*. The diode 81 and the Zener diode 88 are electrically connected in parallel. The cathode of the diode 81 is electrically connected to the signal output terminal TR1 via the capacitor 87*b*. The signal output terminal TR1 is electrically connected to the signal processing unit 6.

The Zener diode 88 gives, for example, an electric potential difference of 350 V between the anode and cathode of the diode 81. In the drive circuit 85 including the equivalent circuit illustrated in FIG. 13, for example, the potential of the anode of the diode 81 is 10 kV, and the potential of the cathode is 10.35 kV. The drive circuit 85 including the equivalent circuit illustrated in FIG. 13 can increase the potential of the anode of the diode 81 in a positive direction, thus increasing a gain of the detection signal SG1. An electrical resistance value of the resistor 86*a* is, for example, 1 kΩ. The electrical resistance value of the resistor 86*b* is, for example, 100 kΩ.

As illustrated in FIG. 13, the node N1 is electrically connected to the side surface of the coaxial connector 84 via the capacitor 87*a*. The node N1 is located between the diode 81 and the resistor 86*a*. The side surface of the coaxial connector 84 is grounded. The node N1 is disposed to constitute a coupling capacitor. The cathode of the diode 81 is electrically connected to the signal output terminal TR1 via the capacitor 87*b*. The capacitor 87*a* and the capacitor 87*b* are electrically connected in parallel. The capacitors 87*a* and 87*b* constitute a coupling capacitor. The capacitors 87*a* and 87*b* enable the current (detection signal SG1) from the diode 81 to flow to the signal output terminal TR1 while maintaining the high electric potential of the diode 81. Even in a case the detection signal SG1 is a high-speed signal, the capacitors 87*a* and 87*b* can effectively transmit the AC component of the detection signal SG1. The capacity of the capacitors 87*a* and 87*b* is, for example, 150 pF. A node N2 is electrically connected to the grounded resistor 86*c*. The node N2 is located between the Zener diode 88 and the resistor 86*b*. The resistor 86*c* is electrically connected to the anode of the diode 81 via the resistor 86*a*. The electric potential at one end of the resistor 86*c* is the same as the potential at the anode of the diode 81. Another end of the resistor 86*c* is grounded. For example, a current of 100 μA flows through the resistor 86*c* under a potential of 10 kV. The electrical resistance value of the resistor 86*c* is, for example, 100 MΩ. The resistor 86*c* generates, for example, 1 W of heat. The drive circuit 85 in the configuration in which the avalanche diode is used as the diode 81 and the drive circuit 85 in the configuration in which the above-mentioned ordinary diode is used as the diode 81 have the same equivalent circuit. For example, the resistor 86*c* constitutes an electrical resistance element.

Figure 14:
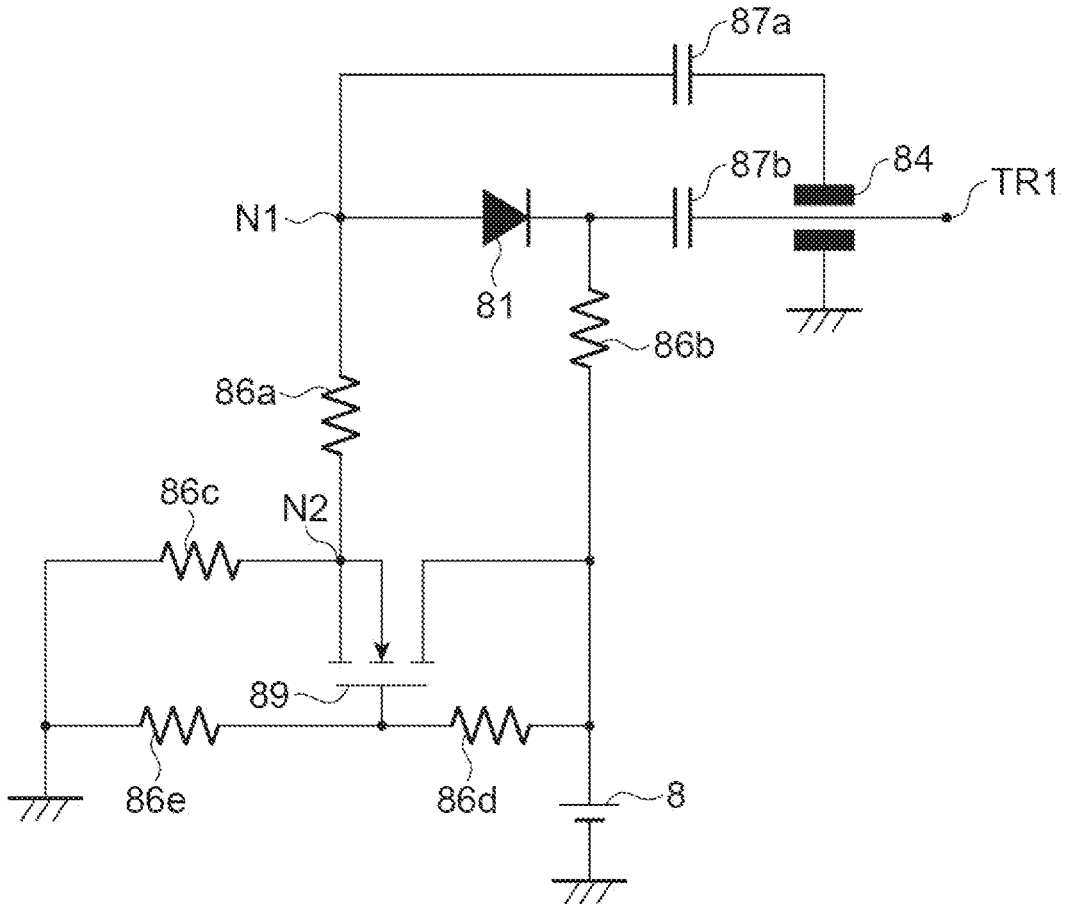
FIG. 14 is a diagram illustrating an equivalent circuit of the drive circuit of the diode.

As illustrated in FIG. 14, the drive circuit 85 includes, for example, the diode 81, an n-Channel Metal-Oxide Semiconductor (NMOS) 89, resistors 86*a*, 86*b*, 86*c*, 86*d*, and 86*e*, the capacitors 87*a* and 87*b*, and the coaxial connector 84. FIG. 14 is a diagram illustrating an equivalent circuit of the drive circuit of the diode. The NMOS 89 is an example of field effect transistor (FET). The anode of the diode 81 is electrically connected to the power source unit 8 via the resistor 86*a* and the NMOS 89. A source of the NMOS 89 is electrically connected to the resistor 86*a*. A drain of the NMOS 89 is electrically connected to the power source unit 8. A gate of the NMOS 89 is electrically connected to the power source unit 8 via the resistor 86*d* and grounded via the resistor 86*e*. The diode 81 includes the anode on the electron incident surface 82 side. The potential of the power source unit 8 is, for example, 10.35 kV. The cathode of the diode 81 is electrically connected to the power source unit 8 via the resistor 86*b*. The diode 81 and the NMOS 89 are electrically connected in parallel. The cathode of the diode 81 is electrically connected to the signal output terminal TR1 via the capacitor 87*b*. The signal output terminal TR1 is electrically connected to the signal processing unit 6.

The NMOS 89 creates an electric potential difference of, for example, 350 V between the anode and cathode of the diode 81. In this modification, the potential of the anode of the diode 81 is 10 kV, and the potential of the cathode is 10.35 kV. In this modification, since the potential of the anode of the diode 81 can be increased, the gain of the detection signal SG1 is increased. An electrical resistance value of the resistor 86*a* is, for example, 1 kΩ. The electrical resistance value of the resistor 86*b* is, for example, 100 kΩ. The electrical resistance value of the resistor 86*c* is, for example, 100 MΩ. The electrical resistance value of the resistor 86*d* is, for example, 35 MΩ. The electrical resistance value of the resistor 86*e* is, for example, 1 GΩ.

In this modification, the node N1 is electrically connected to the side surface of the coaxial connector 84 via the capacitor 87*a*. The node N1 is located between the diode 81 and the resistor 86*a*. The side surface of the coaxial connector 84 is grounded. The node N1 is disposed to constitute a coupling capacitor. The cathode of the diode 81 is electrically connected to the signal output terminal TR1 via the capacitor 87*b*. The capacitor 87*a* and the capacitor 87*b* are electrically connected in parallel. The capacitors 87*a* and 87*b* constitute a coupling capacitor. The capacitors 87*a* and 87*b* enable the current (detection signal SG1) from the diode 81 to flow to the signal output terminal TR1 while maintaining the high electric potential of the diode 81. Even in a case the detection signal SG1 is a high-speed signal, the capacitors 87*a* and 87*b* can effectively transfer the AC component of the detection signal SG1. The capacity of the capacitors 87*a* and 87*b* is, for example, 150 pF. A node N2 is electrically connected to the grounded resistor 86*c*. The node N2 is located between the NMOS 89 and the resistor 86*b*. One end of the resistor 86*c* is electrically connected to the anode of the diode 81 via the resistor 86*a*. The potential at one end of the resistor 86*c* is the same as the potential at the anode of the diode 81. Another end of the resistor 86*c* is grounded. For example, a current of 100 μA flows through the resistor 86*c* under a potential of 10 kV. The resistor 86*c* generates, for example, 1 W of heat. An electrical resistance value of the resistor 86*a* is, for example, 1 kΩ. The electrical resistance value of the resistor 86*b* is, for example, 100 kΩ. The electrical resistance value of the resistor 86*c* is, for example, 100 MΩ. The drive circuit 85 in the configuration in which the avalanche diode is used as the diode 81 and the drive circuit 85 in the configuration in which the above-mentioned ordinary diode is used as the diode 81 have the same equivalent circuit.

Figure 15:
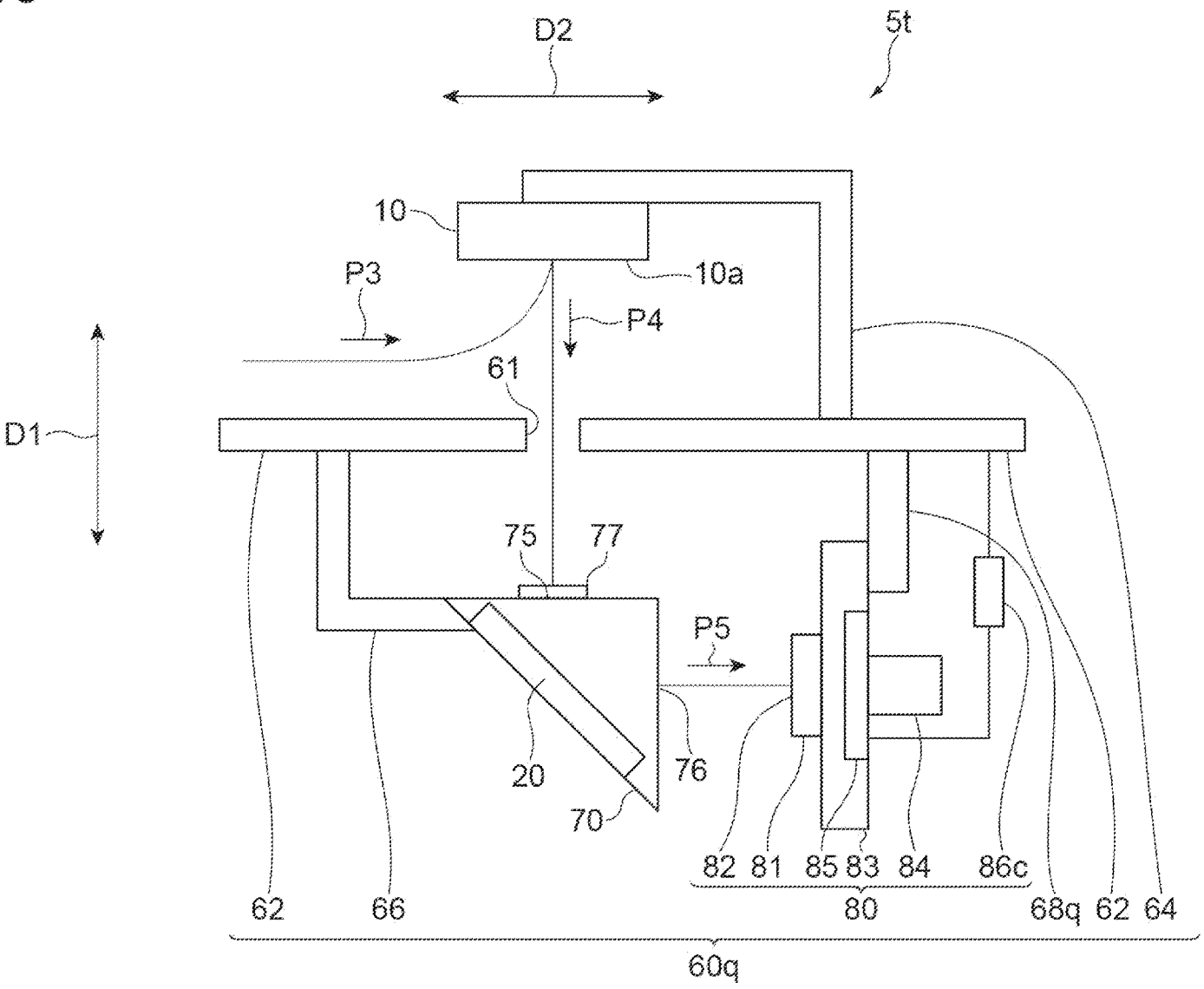
FIG. 15 is a diagram illustrating a fifth modification of the ion detector.

FIG. 15 is a diagram illustrating a fifth modification of the ion detector, and illustrates a modification of the ion detector 5*q* illustrated in FIG. 8. An ion detector 5*t* according to the fifth modification differs from the ion detector 5*q* in terms of the position where the resistor 86*c* is disposed. In the ion detector 5*t*, the resistor 86*c* is spaced apart from the diode 81 and the substrate 83. That is, in the ion detector 5*t*, the resistor 86*c* is physically spaced apart from the diode 81 and the substrate 83, and is thermally spaced apart from the diode 81 and the substrate 83. In this modification, the resistor 86*c* is electrically connected to the base 62 and is grounded. Also, in the ion detector 5*s* illustrated in FIG. 11, in a case the drive circuit 85 includes the resistor 86*c*, the resistor 86*c* may be disposed to be spaced apart from the diode 81 and the substrate 83.

As described above, the ion detectors 5*q*, 5*r*, 5*s*, and 5*t* include the diode 81. The first dynodes 10 and 10*r* emit the charged particle P4 in response to the incidence of the ion P3. The second dynode 20 emits the secondary electron P5 in response to the incidence of the charged particle P4 from the first dynodes 10 and 10*r*. The secondary electron P5 from the second dynode 20 is incident on the diode 81. Since the diode 81 possibly withstands long-term use, life-spans of the ion detectors 5*q*, 5*r*, 5*s*, and 5*t* are extended.

In the ion detectors 5*q*, 5*r*, 5*s*, and 5*t*, the first dynodes 10 and 10*r* are configured to be given a negative potential to convert a positive ion into the secondary electron P5, and the second dynode 20 is configured to allow the secondary electron P5 from the first dynodes 10 and 10*r* to be incident on the electron incident surface 82, in the ion detectors 5*q*, 5*r*, 5*s*, and 5*t* configured to detect the positive ion.

In this case, the positive ion incident on the ion detectors 5*q*, 5*r*, 5*s*, and 5*t* are converted into the secondary electron P5 by the first and second dynodes 10, 10*r*, and 20. The converted secondary electron P5 is incident on the diode 81. The diode 81 reliably detects the incident secondary electron P5 and outputs the electric signal.

In the ion detectors 5*q*, 5*r*, 5*s*, and 5*t*, the first dynodes 10 and 10*r* are configured to be given a positive potential to convert a negative ion into a positive ion, and the second dynode 20 is configured to convert the positive ion from the first dynodes 10 and 10*r* into the secondary electron P5 and allow the secondary electron P5 to be incident on the electron incident surface 82, in the ion detectors 5*q*, 5*r*, 5*s*, and 5*t* configured to detect the negative ion.

In this case, the negative ion incident on the ion detectors 5*q*, 5*r*, 5*s*, and 5*t* is converted into the secondary electron P5 by the first and second dynodes 10, 10*r*, and 20. The secondary electron P5 from the second dynode 20 is incident on the diode 81. The diode 81 reliably detects the incident secondary electron P5 and outputs the electric signal.

The ion detectors 5*q*, 5*r*, 5*s*, and 5*t* further include covers 70 and 70*r* covering the second dynode 20. The covers 70 and 70*r* include first passage ports 75 and 75*r* arranged to allow the charged particle P4 from the first dynodes 10 and 10*r* to pass therethrough and the second passage port 76 arranged to allow the secondary electron P5 from the second dynode 20 to pass therethrough.

In this case, the secondary electron P5 emitted from the second dynode 20 is more reliably directed to the diode 81.

The ion detectors 5*q*, 5*s*, and 5*t* further include the mesh 77 covering the first passage port 75 and being configured to be given a negative potential.

In this case, the mesh 77 reduces that the secondary electron P5 passes through the first passage ports 75 and 75*r* and is directed from the second dynode 20 to the first dynode 10. The secondary electron P5 emitted from the second dynode 20 is more reliably directed to the diode 81.

In the ion detector 5*r*, the first dynode 10*r* is disposed to be spaced apart from the virtual plane V1 including the second dynode 20, the second passage port 76, and the electron incident surface 82. The first dynode 10*r* is configured to allow the charged particle P4 from the first dynode 10*r* to be incident on the second dynode 20 from a direction D1*r* intersecting the virtual plane V1.

In this case, the secondary electron P5 emitted from the second dynode 20 tends not to be directed to the first dynode 10*r*. The secondary electron P5 emitted from the second dynode 20 more reliably tends to be directed to the diode 81.

The ion detector 5*t* includes the substrate 83 on which the diode 81 is disposed and the drive circuit 85 configured to drive the diode 81. The drive circuit 85 includes the resistor 86*c* including one end electrically connected to an anode of the diode 81, and another end configured to be grounded. The resistor 86*c* is spaced apart from the diode 81 and the substrate 83.

Depending on the value of the current flowing through the resistor 86*c*, a calorific value of the resistor 86*c* may increase. If the heat generated in the resistor 86*c* is transferred to the diode 81, a gain of the diode 81 may decrease. In the ion detector 5*t*, as described above, the resistor 86*c* is spaced apart from the diode 81. Therefore, the heat generated in the resistor 86*c* tends not to be transferred to the diode 81. As a result, even in a case the calorific value of the resistor 86*c* increases, the gain of the diode 81 tends not to decrease.

The ion detectors 5*q*, 5*r*, 5*s*, and 5*t* include the first dynodes 10 and 10*r* configured to emit the charged particle P4 in response to the incidence of the ion P3, the second dynode 20 configured to be given a negative potential and emit the secondary electron P5 in response to the incidence of the charged particle P4 from the first dynodes 10 and 10*r*, and the detection unit 80 including the electron incident surface 82 arranged to receive the secondary electron P5 from the second dynode 20, and configured to detect the incident secondary electron P5.

The ion detectors 5*q*, 5*r*, 5*s*, and 5*t* include the detection unit 80 that detects the incident secondary electron P5. The first dynodes 10 and 10*r* are configured to emit the charged particle P4 in response to the incidence of the ion P3, and the second dynode 20 is configured to emit the secondary electron P5 in response to the incidence of the charged particle P4 from the first dynodes 10 and 10*r*. The secondary electron P5 from the second dynode 20 is incident on the detection unit 80. Since the detection unit 80 possibly include a configuration that withstands long-term use, life-spans of the ion detectors 5*q*, 5*r*, 5*s*, and 5*t* are extended.

The mass spectrometer 1 includes the ion detectors 5*q*, 5*r*, 5*s*, and 5*t* having a long life-span. The life-span of the mass spectrometer 1 is extended.

Although the embodiment and modification of the present invention has been described above, the present invention is not necessarily limited to the embodiment, and the embodiment can be variously changed without departing from the scope of the invention.

The ion detectors 5, 5*p*, 5*q*, 5*r*, 5*s*, and 5*t* may be provided in an apparatus other than the mass spectrometer 1.

The conductive layer 46 does not have to be electrically connected to the side tube 54. In the configuration in which the electrically conductive layer 46 is electrically connected to the side tube 54, the number of power sources is reduced as described above.

The mass spectrometer 1 (ion detectors 5, 5*p*, 5*q*, 5*r*, 5*s*, and 5*t*) does not have to include the covers 70, 70*p*, and 70*r* that include the first passage ports 75, 75*p*, and 75*r* and the second passage port 76. In the configuration provided with the covers 70, 70*p*, and 70*r* that include the first passage ports 75, 75*p*, and 75*r* and the second passage port 76, as described above, the secondary electron P5 emitted from the second dynode 20 is more reliably directed to the scintillator 40 or the diode 81.

The mass spectrometer 1 (ion detectors 5, 5*p*, 5*q*, 5*r*, 5*s*, and 5*t*) does not have to include the mesh 77. In the configuration provided with the mesh 77, as described above, the secondary electron P5 emitted from the second dynode 20 is more reliably directed to the scintillator 40 or the diode 81.

What is claimed is:

1. An ion detector for detecting an incident ion, comprising:

a first dynode configured to emit a charged particle in response to incidence of the ion;

a second dynode configured to be given a negative potential and emit a secondary electron in response to incidence of the charged particle from the first dynode;

a scintillator including an electron incident surface arranged to receive the secondary electron from the second dynode, and configured to convert the secondary electron into light;

a conductive layer disposed on the electron incident surface; and a photomultiplier tube configured to detect the light from the scintillator.

2. The ion detector according to claim 1, wherein the scintillator includes a light exit surface arranged to emit light, the photomultiplier tube includes a light incident window arranged to receive the light from the light exit surface, and the light exit surface is disposed in close proximity to the light incident window.

3. The ion detector according to claim 1, wherein the first dynode is configured to be given a negative potential to convert a positive ion into the secondary electron, and the second dynode is configured to allow the secondary electron from the first dynode to be incident on the electron incident surface of the scintillator, in the ion detector configured to detect the positive ion.

4. The ion detector according to claim 1, wherein the first dynode is configured to be given a positive potential to convert a negative ion into a positive ion, and the second dynode is configured to convert the positive ion from the first dynode into the secondary electron and allow the secondary electron to be incident on the electron incident surface of the scintillator, in the ion detector configured to detect the negative ion.

5. The ion detector according to claim 1, wherein the scintillator is configured to be given a negative potential, and the second dynode is configured to be given the negative potential whose magnitude is larger than a magnitude of the negative potential given to the scintillator.

6. The ion detector according to claim 3, wherein the second dynode is configured to be given a negative potential whose magnitude is between a magnitude of the negative potential given to the first dynode and a magnitude of the negative potential given to the scintillator, in the ion detector configured to detect a positive ion.

7. The ion detector according to claim 1, wherein the photomultiplier tube includes a side tube configured to be given a cathode potential, and the conductive layer is electrically connected to the side tube.

8. The ion detector according to claim 1, further comprising a cover covering the second dynode, wherein the cover includes a first passage port arranged to allow the charged particle from the first dynode to pass therethrough and a second passage port arranged to allow the secondary electron from the second dynode to pass therethrough.

9. The ion detector according to claim 8, further comprising a mesh covering the first passage port and being configured to be given a negative potential.

10. The ion detector according to claim 8, wherein the first dynode is disposed to be spaced apart from a virtual plane including the second dynode, the second passage port, and the electron incident surface of the scintillator, and the first dynode is configured to allow the charged particle from the first dynode to be incident on the second dynode from a direction intersecting the virtual plane.

11. An ion detector for detecting an incident ion, comprising:

a first dynode configured to emit a charged particle in response to incidence of the ion;

a second dynode configured to be given a negative potential and emit a secondary electron in response to incidence of the charged particle from the first dynode; and a diode including an electron incident surface arranged to receive the secondary electron from the second dynode, and configured to detect the incident secondary electron.

12. The ion detector according to claim 11, wherein the first dynode is configured to be given a negative potential to convert a positive ion into the secondary electron, and the second dynode is configured to allow the secondary electron from the first dynode to be incident on the electron incident surface, in the ion detector configured to detect the positive ion.

13. The ion detector according to claim 11, wherein the first dynode is configured to be given a positive potential to convert a negative ion into a positive ion, and the second dynode is configured to convert the positive ion from the first dynode into the secondary electron and allow the secondary electron to be incident on the electron incident surface, in the ion detector configured to detect the negative ion.

14. The ion detector according to claim 11, further comprising a cover covering the second dynode, wherein the cover includes a first passage port arranged to allow the charged particle from the first dynode to pass therethrough and a second passage port arranged to allow the secondary electron from the second dynode to pass therethrough.

15. The ion detector according to claim 14, further comprising a mesh covering the first passage port and being configured to be given a negative potential.

16. The ion detector according to claim 14, wherein the first dynode is disposed to be spaced apart from a virtual plane including the second dynode, the second passage port, and the electron incident surface, and the first dynode is configured to allow the charged particle from the first dynode to be incident on the second dynode from a direction intersecting the virtual plane.

17. The ion detector according to claim 11, further comprising:

a substrate on which the diode is disposed; and a drive circuit configured to drive the diode, wherein the drive circuit includes an electrical resistance element including one end electrically connected to an anode of the diode, and another end configured to be grounded, and the electrical resistance element is spaced apart from the diode and the substrate.

18. An ion detector for detecting an incident ion, comprising:

a first dynode configured to emit a charged particle in response to incidence of the ion;

a second dynode configured to be given a negative potential and emit a secondary electron in response to incidence of the charged particle from the first dynode; and a detection unit including an electron incident surface arranged to receive the secondary electron from the second dynode, and configured to detect the incident secondary electron.

19. A mass spectrometer comprising:

an ionization unit configured to ionize a sample;

a mass spectrometer unit configured to allow only an ion to be detected to pass among ions from the ionization unit; and the ion detector according to claim 1 configured to detect the ion to be detected from the mass spectrometer unit.

20. A mass spectrometer comprising:

an ionization unit configured to ionize a sample;

a mass spectrometer unit configured to allow only an ion to be detected to pass among ions from the ionization unit; and the ion detector according to claim 11 configured to detect the ion to be detected from the mass spectrometer unit.

21. A mass spectrometer comprising:

an ionization unit configured to ionize a sample;

a mass spectrometer unit configured to allow only an ion to be detected to pass among ions from the ionization unit; and the ion detector according to claim 18 configured to detect the ion to be detected from the mass spectrometer unit.

* * * * *